US010249289B2

(12) United States Patent
Chun et al.

(10) Patent No.: US 10,249,289 B2
(45) Date of Patent: Apr. 2, 2019

(54) TEXT-TO-SPEECH SYNTHESIS USING AN AUTOENCODER

(71) Applicant: Google LLC, Mountain View, CA (US)

(72) Inventors: Byung Ha Chun, Epsom (GB); Javier Gonzalvo, New York, NY (US); Chun-an Chan, London (GB); Ioannis Agiomyrgiannakis, London (GB); Vincent Ping Leung Wan, Cambridge (GB); Robert Andrew James Clark, Hertfordshire (GB); Jakub Vit, Plzen Plzenský kraj (CZ)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/649,311

(22) Filed: Jul. 13, 2017

(65) Prior Publication Data

US 2018/0268806 A1 Sep. 20, 2018

(30) Foreign Application Priority Data

Mar. 14, 2017 (GR) ..... 20170100100

(51) Int. Cl.
*G10L 13/06* (2013.01)
*G10L 19/00* (2013.01)
(Continued)

(52) U.S. Cl.
CPC ..... *G10L 13/047* (2013.01); *G10L 13/027* (2013.01); *G10L 13/06* (2013.01); *G10L 19/0019* (2013.01); *G10L 25/30* (2013.01)

(58) Field of Classification Search
CPC ..... G10L 13/08; G10L 25/30
See application file for complete search history.

(56) References Cited

U.S. PATENT DOCUMENTS 8,484,022 B1 7/2013 Vanhoucke
9,484,014 B1 * 11/2016 Kaszczuk ..... G10L 13/06
(Continued)

FOREIGN PATENT DOCUMENTS

WO 2017/031356 2/2017

OTHER PUBLICATIONS

Arik SO, Chrzanowski M, Coates A, Diamos G, Gibiansky A, Kang Y, Li X, Miller J, Ng A, Raiman J, Sengupta S. Deep voice: Real-time neural text-to-speech. arXiv preprint arXiv:1702.07825. Feb. 25, 2017. (Year: 2017).*
(Continued)

*Primary Examiner* — Brian L Albertalli
(74) *Attorney, Agent, or Firm* — Fish & Richardson P.C.

(57) ABSTRACT

Methods, systems, and computer-readable media for text-to-speech synthesis using an autoencoder. In some implementations, data indicating a text for text-to-speech synthesis is obtained. Data indicating a linguistic unit of the text is provided as input to an encoder. The encoder is configured to output speech unit representations indicative of acoustic characteristics based on linguistic information. A speech unit representation that the encoder outputs is received. A speech unit is selected to represent the linguistic unit, the speech unit being selected from among a collection of speech units based on the speech unit representation output by the encoder. Audio data for a synthesized utterance of the text that includes the selected speech unit is provided.

17 Claims, 6 Drawing Sheets

(51) Int. Cl.

| | |
|---|---|
| ***G10L 25/30*** | (2013.01) |
| ***G10L 13/027*** | (2013.01) |
| ***G10L 13/047*** | (2013.01) |

(56) References Cited

U.S. PATENT DOCUMENTS

| | | | | |
|---|---|---|---|---|
| 2005/0058339 | A1 | 3/2005 | Kato et al. | |
| 2005/0182629 | A1* | 8/2005 | Coorman | G10L 13/06 704/266 |
| 2016/0093289 | A1 | 3/2016 | Pollet | |
| 2016/0232440 | A1* | 8/2016 | Gregor | G06N 3/0445 |
| 2017/0004397 | A1 | 1/2017 | Yumer et al. | |
| 2017/0046563 | A1 | 2/2017 | Kim et al. | |
| 2017/0092259 | A1* | 3/2017 | Jeon | G10L 13/07 |
| 2018/0096677 | A1* | 4/2018 | Pollet | G10L 13/02 |

OTHER PUBLICATIONS

Vishnubhotla, Srikanth, Raul Fernandez, and Bhuvana Ramabhadran. "An autoencoder neural-network based low-dimensionality approach to excitation modeling for HMM-based text-to-speech." Acoustics Speech and Signal Processing (ICASSP), 2010 IEEE International Conference on. IEEE, 2010. (Year: 2010).*

Takaki, Shinji, and Junichi Yamagishi. "A deep auto-encoder based low-dimensional feature extraction from FFT spectral envelopes for statistical parametric speech synthesis." Acoustics, Speech and Signal Processing (ICASSP), 2016 IEEE International Conference on. IEEE, 2016. (Year: 2016).*

Takaki, Shinji, and Junichi Yamagishi. "Constructing a deep neural network based spectral model for statistical speech synthesis." Recent Advances in Nonlinear Speech Processing. Springer, Cham, 2016. 117-125. (Year: 2016).*

Bandanau et al. "Neural Machine Translation by Jointly Learning to Align and Translate," ICLR, Jan. 1, 2015, 15 pages.

Extended European Search Report issued in European Application No. 17199456.9, dated Mar. 7, 2018, 10 pages.

Achanta et al. "Statistical parametric speech synthesis using bottleneck representation from sequence auto-encoder," arXiv preprint arXiv1606.05844v1, Jun. 19, 2016, 5 pages.

Agiomyrgiannakis "Vocaine the vocoder and application in speech synthesis," IEEE International Conference on Acoustics, Speech, and Signal Processing, Apr. 19, 2015, 5 pages.

Chen et al. "The USTC system for Blizzard Challenge 2016," Proceedings Blizzard Challenge, 2016, 6 pages.

Frome et al. "DeViSE: A deep visual-semantic embedding model," Advances in Neural Information Processing Systems, 26, 2013, 9 pages.

Gonzalvo et al. "Recent advances in Google real-time HMM-driven unit selection synthesizer," Interspeech, Sep. 8-12, 2016, 5 pages.

Hunt et al. "Unit selection in a concatenative speech synthesis system using a large speech database," Proceedings of the Acoustics, Speech, and Signal Processing, May 7, 1996, 4 pages.

Merritt et al. "Deep neural network-guided unit selection synthesis," 2016 IEEE International Conference on Acoustics, Speech and Signal Processing, Mar. 2016, 5 pages.

Tao et al. "BLSTM guided unit selection synthesis system for Blizzard Challenge 2016," Proceedings Blizzard Challenge, 2016, 6 pages.

Van den Oord et al. "WaveNet: A generative model for raw audio," arXiv preprint arXiv 1609.03499v2, Sep. 19, 2016, 15 pages.

Weston et al. "Large scale image annotation: learning to rant with joint word-image embeddings," Machine Learning, 81(1), Oct. 1, 2010, 16 pages.

Zen et al. "Fast, compact and high quality LSTM-RNN based statistical parametric speech synthesizers for mobile devices, " arXiv preprint arXiv1606.06061, Jun. 20, 2016, 14 pages.

Zen et al. "Statistical parametric speech synthesis using deep neural networks," IEEE International Conference on Acoustics, Speech and Signal Processing, May 26, 2013, 5 pages.

Zen et al. "Unidirectional long short-term memory recurrent neural network with recurrent output layer for low-latency speech synthesis," 2015 IEEE International Conference on Acoustics, Speech and Signal Processing, Apr. 19, 2015, 5 pages.

* cited by examiner

TEXT-TO-SPEECH SYNTHESIS USING AN AUTOENCODER

CROSS-REFERENCE TO RELATED APPLICATION

This application claims priority under 35 U.S.C. § 119 to Greek Patent Application No. 20170100100, filed in Greece on Mar. 14, 2017, the entire contents of which is incorporated by reference herein.

BACKGROUND

This specification relates generally to text-to-speech synthesis and more specifically to text-to-speech synthesis using neural networks.

Neural networks can be used to perform text-to-speech synthesis. Typically, text-to-speech synthesis attempts to generate a synthesized utterance of a text that approximates the sound of human speech.

SUMMARY

In some implementations, a text-to-speech system includes an encoder trained as part of an autoencoder network. The encoder is configured to receive linguistic information for a speech unit, such as an identifier for a phone or diphone, and generate an output indicative of acoustic characteristics of the speech unit in response. The output of the encoder can encode characteristics of speech units having different sizes in output vectors of a single size. To select a speech unit to use in unit-selection speech synthesis, an identifier of a linguistic unit can be provided as input to the encoder. The resulting output of the encoder can be used to retrieve candidate speech units from a corpus of speech units. For example, a vector that includes at least the output of the encoder can be compared with vectors comprising the encoder outputs for speech units in the corpus.

In some implementations, the autoencoder network includes a linguistic encoder, an acoustic encoder, and a decoder. The linguistic encoder and the acoustic encoder are both trained to generate speech unit representations for a speech unit based on different types of input. The linguistic encoder is trained to generate speech unit representations based on linguistic information. The acoustic encoder is trained to generate speech unit representations based on acoustic information, such as feature vectors that describe audio characteristics of the speech unit. The autoencoder network is trained to minimize a distance between the speech unit representations generated by the linguistic encoder and the acoustic encoder. The linguistic encoder, the acoustic encoder, and the decoder can each include one or more long short-term memory layers.

In one general aspect, a method is performed by one or more computers of a text-to-speech system. The method includes: obtaining, by the one or more computers, data indicating a text for text-to-speech synthesis; providing, by the one or more computers, data indicating a linguistic unit of the text as input to an encoder, the encoder being configured to output speech unit representations indicative of acoustic characteristics based on linguistic information, where the encoder is configured to provide speech unit representations learned through machine learning training; receiving, by the one or more computers, a speech unit representation that the encoder outputs in response to receiving the data indicating the linguistic unit as input to the encoder; selecting, by the one or more computers, a speech unit to represent the linguistic unit, the speech unit being selected from among a collection of speech units based on the speech unit representation output by the encoder; and providing, by the one or more computers and as output of the text-to-speech system, audio data for a synthesized utterance of the text that includes the selected speech unit.

Other embodiments of this and other aspects of the disclosure include corresponding systems, apparatus, and computer programs, configured to perform the actions of the methods, encoded on computer storage devices. A system of one or more computers can be so configured by virtue of software, firmware, hardware, or a combination of them installed on the system that in operation cause the system to perform the actions. One or more computer programs can be so configured by virtue having instructions that, when executed by data processing apparatus, cause the apparatus to perform the actions.

Implementations may include one or more of the following features. For example, in some implementations, the encoder is configured to provide speech unit representations of a same size to represent speech units having different durations.

In some implementations, the encoder is trained to infer speech unit representations from linguistic unit identifiers, and the speech unit representations output by the encoder are vectors that have a same fixed length.

In some implementations, the encoder includes a trained neural network having one or more long-short-term memory layers.

In some implementations, the encoder includes a neural network that was trained as part of an autoencoder network that includes the encoder, a second encoder, and a decoder. The encoder is arranged to produce speech unit representations in response to receiving data indicating linguistic units. The second encoder is arranged to produce speech unit representations in response to receiving data indicating acoustic features of speech units. The decoder is arranged to generate output indicating acoustic features of speech units in response to receiving speech unit representations for the speech units from the encoder or the second encoder.

In some implementations, the encoder, the second encoder, and the decoder are trained jointly, and the encoder, the second encoder, and the decoder each include one or more long short-term memory layers.

In some implementations, the encoder, the second encoder, and the decoder are trained jointly using a cost function configured to minimize (i) differences between acoustic features input to the second encoder and acoustic features generated by the decoder, and (ii) differences between the speech unit representations of the encoder and the speech unit representations of the second encoder.

In some implementations, the method further includes selecting a set of candidate speech units for the linguistic unit based on a vector distances between (i) a first vector that includes the speech unit representation output by the encoder and (ii) second vectors corresponding to speech units in the collection of speech units; and generating a lattice that includes nodes corresponding to the candidate speech units in the selected set of candidate speech units.

In some implementations, selecting the set of candidate speech units includes: identifying a predetermined quantity of second vectors that are nearest neighbors for the first vector; and selecting, as the set of candidate speech units, a set of speech units corresponding to the identified predetermined quantity of second vectors that are nearest neighbors for the first vector.

In some implementations, the speech unit representation for the linguistic unit is a first speech unit representation for a first linguistic unit, where selecting the speech unit includes: obtaining a second speech unit representation for a second linguistic unit that occurs immediately before or after the first linguistic unit in a phonetic representation of the text; generating a diphone unit representation by concatenating the first speech unit representation with the second speech unit representation; and selecting, to represent the first linguistic unit, a diphone speech unit identified based on the diphone speech unit representation.

Implementations may provide one or more of the following advantages. For example, the computational complexity of performing text-to-speech synthesis may be reduced using an encoder from an autoencoder network rather than other approaches. This can reduce the amount of power consumption by a text-to-speech synthesis system as well as reduce the amount of computing resources required. As another example, the use of the encoder discussed herein can improve the quality of text-to-speech synthesis by providing output that more closely approximates natural human speech. As another example, the use of the encoder can increase the speed of generating text-to-speech output, which can reduce the latency for providing synthesized speech for output to users.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
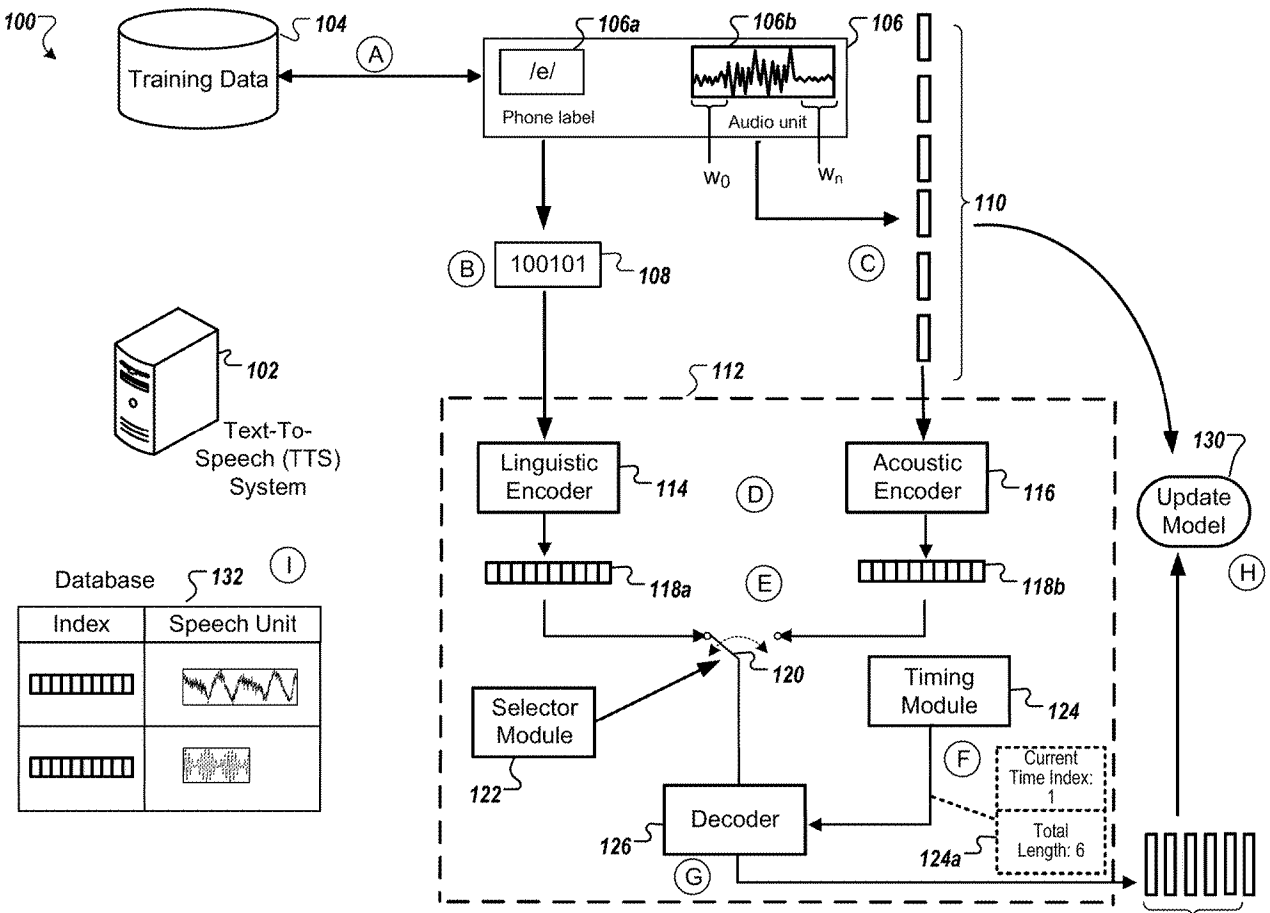
FIGS. 1A and 1B are block diagrams that illustrate an example of a system for text-to-speech synthesis using an autoencoder.

FIG. 1A is a block diagram that illustrates an example of a system 100 for text-to-speech synthesis using an autoencoder. The system 100 includes a text-to-speech (TTS) system 102 and data storage 104. The TTS system 102 can include one or more computers. The TTS system 102 includes an autoencoder network 112, which includes a linguistic encoder 114, an acoustic encoder 116, a selector module 122, a timing module 124, and a decoder 126. The TTS system 102 may include one or more servers connected locally or over a network. The autoencoder network 112 may be implemented in software, hardware, firmware, or a combination thereof. FIG. 1A illustrates various operations in stages (A) to (I) which can be performed in the sequence indicated or in another sequence.

The example of FIG. 1A shows an example of the TTS system 102 training the autoencoder network 112. The processing shown in FIG. 1A achieves two important tasks. First, the linguistic encoder 114 is trained to predict a representation of acoustic characteristics in response to linguistic information. Second, the TTS system 102 creates a database 132 or other data structure that allows speech units to be retrieved based on the outputs of the linguistic encoder 114. Together, the trained linguistic encoder 114 and the speech unit database 132 allow the TTS system 102 to accurately and efficiently look up an appropriate speech unit to express a linguistic unit, as discussed with respect to FIG. 1B.

Through training, the linguistic encoder 114 learns to produce a speech unit representation or "embedding" for a linguistic unit. The linguistic encoder 114 receives data indicating a linguistic unit, such as a phoneme, and provides an embedding representing acoustic characteristics that express the linguistic unit. The embeddings provided by the linguistic encoder 114 each have the same fixed size, even though they may represent speech units of different sizes. After training, the linguistic encoder 114 is able to produce embeddings that encode acoustic information from linguistic information alone. This allows the linguistic encoder 114 to receive data specifying a linguistic unit and produce an embedding that represents the audio characteristics for a speech unit that would be appropriate to express the linguistic unit.

In the autoencoder network 112, the linguistic encoder 114 and the acoustic encoder 116 each learn to produce embeddings based on different types of input. The linguistic encoder 114 generates an embedding from data specifying a linguistic unit, e.g., without information indicating the acoustic properties that are expected. The acoustic encoder 116 generates an embedding from data indicating acoustic characteristics of actual speech units.

The TTS system 102 trains the autoencoder network 112 in a manner that the linguistic encoder 114 and the acoustic encoder 116 learn to output similar embeddings for a given speech unit. This result is achieved by training both of the encoders 114, 116 with the same decoder 126. The decoder 126 generates acoustic feature vectors from a received embedding. The decoder 126 is not informed whether an embedding is produced by the linguistic encoder 114 or the acoustic encoder 116, which requires the decoder to interpret embeddings in the same manner regardless of the source. As training progresses, the use of the shared decoder 126 forces the encoders 114, 116 to produce embeddings that are similar. To facilitate the training, the TTS system 102 trains the linguistic encoder 114, the acoustic encoder 116, and the decoder 126 jointly.

During stage (A), the TTS system 102 obtains training data from the data storage 104. The training data can include many different speech units representing many different linguistic units. The training data can also include speech from multiple speakers. In some implementations, each training example includes acoustic information and linguistic information. The acoustic information may include audio data, e.g., data for an audio waveform or other representation of audio, and the acoustic information may include vectors of acoustic features derived from audio data. The linguistic information can indicate which linguistic unit the acoustic information expresses. The linguistic units may be phonetic units, such as phones, diphones, states or components of phones, syllables, moras, or other phonetic units. The linguistic units may be context-dependent, for example, context-dependent phones that each represent a particular phone that follows one or more prior phones and is followed by one or more subsequent phones.

In the illustrated example, the TTS system 102 obtains a training example 106, which includes a linguistic label 106*a* and associated audio data 106*b*. For example, the label 106*a* indicates that the audio data 106*b* represents an "/e/" phone. In some implementations, the TTS system 102 may extract examples representing individual linguistic units from longer audio segments. For example, the data storage 104 can include audio data for utterances and corresponding text transcriptions of the utterances. The TTS system 102 can use a lexicon to identify a sequence of linguistic units, such as phones, for each text transcription. The TTS system 102 can then align the sequence of linguistic units with the audio data and extract audio segments representing individual linguistic units. The training data can include examples of each linguistic unit that the TTS system 102 is designed to use.

During stage (B), the TTS system 102 determines a linguistic unit identifier 108 corresponding to the linguistic label 106*a*. The TTS system 102 provides the linguistic unit identifier 108 as input to the linguistic encoder 114. As discussed below, the linguistic unit identifier 108 specifies a particular linguistic unit, e.g., the phone "/e" in the illustrated example.

The linguistic encoder 114 can be trained to generate an embedding for each linguistic unit in a predetermined set of linguistic units. Each of the linguistic units can be assigned a different linguistic unit identifier. The linguistic unit identifiers can be provided as input to the linguistic encoder 114, with each identifier specifying a respective linguistic unit. In some implementations, the linguistic label 106*a* is the linguistic unit identifier 108. In some implementations, the TTS system 102 creates or accesses a mapping between linguistic unit labels and identifiers provided to the linguistic encoder 114. The mapping between linguistic units and their corresponding linguistic unit identifiers can remain consistent during training and also during use of the trained linguistic encoder 114 to synthesize speech, so each linguistic unit identifier consistently identifies a single linguistic unit. In the illustrated example, the TTS system 102 determines that a binary vector "100101" is the appropriate linguistic unit identifier 108 for the linguistic unit "/e/" indicated by the label 106*a*.

During stage (C), the TTS system 102 obtains one or more acoustic feature vectors 110 that indicate the acoustic characteristics of the audio data 106*b*. The TTS system 102 provides the feature vectors one-by-one as input to the acoustic encoder 116.

The TTS system 102 may access stored feature vectors for the audio data 106*b* from the data storage 104 or perform feature extraction on the audio data 106*b*. For example, the TTS system 102 analyzes different segments or analysis windows of the audio data 106*b*. These windows are shown as $w_0, \ldots w_n$, and can be referred to as frames of the audio. In some implementations, each window or frame represents the same fixed-size amount of audio, e.g., 5 milliseconds (ms) of audio. The windows may partially overlap or may not overlap. For the audio data 106, a first frame $w_0$ may represent the segment from 0 ms to 5 ms, a second window $w_1$ may represent a segment from 5 ms to 10 ms, and so on.

A feature vector 110, or a set of acoustic feature values, may be determined for each frame of the audio data 106*b*. For example, the TTS system 102 performs a Fast Fourier Transform (FFT) on the audio in each window $w_0, \ldots w_n$ and analyzes the frequency content present to determine the acoustic features for each window. The acoustic features may be MFCCs, features determined using a perceptual linear prediction (PLP) transform, or features determined using other techniques. In some implementations, the logarithm of the energy in each of various bands of the FFT may be used to determine acoustic features.

The TTS system 102 may provide (i) data indicating the linguistic unit of the training example 106 and (ii) data indicating the acoustic features of the training example as input to the autoencoder network 112. For example, the TTS system 102 can input the linguistic unit identifier 108 to the linguistic encoder 114 of the autoencoder network 112. Additionally, the TTS system 102 can input the acoustic feature vectors 110 to an acoustic encoder 116 of the autoencoder network. For example, the TTS system 102 inputs the acoustic feature vectors 110 sequentially to the acoustic encoder 116, one feature vector 110 at a time.

The linguistic encoder 114 and the acoustic encoder 116 may each include one or more neural network layers. For example, each of the encoders 114, 116 may include recurrent neural network elements, such as one or more long short-term memory (LSTM) layers. The neural network in the linguistic encoder 114 and the acoustic encoder 116 may be a deep LSTM neural network architecture built by stacking multiple LSTM layers. The neural network in the linguistic encoder 114 can be trained to provide output of a fixed-size speech unit representation or embedding. The neural network in the acoustic encoder 116 can also be trained to provide output of a fixed-size speech unit representation or embedding of the same size as the output of the linguistic encoder 114.

During stage (D), the linguistic encoder 114 outputs an embedding 118*a* in response to the linguistic unit identifier 108. The acoustic encoder 116 outputs an embedding 118*b* in response to the acoustic feature vectors 110. Embeddings 118*a* and 118*b* can be the same size as each other, and can be the same size for all linguistic units and lengths of audio data. For example, the embeddings 118*a* and 118*b* may be 32-bit vectors.

In the case of the linguistic encoder 114, a single set of input is provided for each single-unit training example. Accordingly, the embedding 118*a* can be the output vector produced once the input of the linguistic unit identifier 108 has propagated through the neural network of the linguistic encoder 114.

In the case of the acoustic encoder 116, multiple acoustic feature vectors 110 may be input to the acoustic encoder 116, and the number of feature vectors 110 varies according to the length of the audio data 106*b* of the training example 106. For example, with frames that last 5 ms, an audio unit that 25 ms long would have five feature vectors, and an audio unit that is 40 ms long would have eight feature vectors. To account for these differences, the embedding 118*b* from the acoustic encoder 118*b* is the output produced once the last feature vector 110 propagates through the neural network of the acoustic encoder 116. In the illustrated example, there are six feature vectors that are input sequentially, with each at a different time step. The outputs of the acoustic encoder 116 are ignored until the last of the feature vectors 110 has propagated through, when the acoustic encoder 116 has been able to receive the entire sequence of feature vectors 110 and also determine the full length of the sequence.

During stage (E), the selector module 122 selects whether the decoder 126 should receive (i) the embedding 118*a* from the linguistic encoder 114 or (ii) the embedding 118*b* from the acoustic encoder 116. The selector module 122 can set a switch 120 randomly for each training example, according to a fixed probability. In other words, the selector module 122 can determine, for each for each training example 106, whether the embedding from the linguistic encoder 114 or the acoustic encoder 116 will be provided to the decoder 126. The probability that the embedding 118*a*, or 118*b* will be used for any given training example can be set by a probability parameter. For example, a probability value of 0.5 may set an equal likelihood that either embedding 118*a*, 118*b* will be selected. As another example, a probability value of 0.7 may weight the selection so there is a 70% likelihood of selecting the embedding 118*a* and a 30% likelihood of selecting embedding 118*b*.

The switching between outputs of the encoders 114, 116 facilitates training of the linguistic encoder. The acoustic encoder 116 and linguistic encoder 114 receive distinct, non-overlapping inputs and do not interact directly with each other. Nevertheless, the use of a shared decoder 126 allows the TTS system 102 to more easily minimize the differences between the embeddings 118*a*, 118*b* of the different encoders 114, 116. In particular, the joint training of the encoders 114, 116 and the decoder 126, along with the switching between which encoder 114, 116 provides the embedding to the decoder 126, causes the linguistic encoder to produce embeddings that are indicative of audio characteristics.

During stage (F), the TTS system 102 provides inputs to the decoder 126. The TTS system 102 provides the embedding selected by the selector module 122 and switch 120. The TTS system 102 also provides timing information from the timing module 124 to the decoder 126.

The decoder 126 attempts to recreate a sequence of feature vectors 110 based on the embedding 118*a* or the embedding 118*b*. An embedding is the same size regardless of the duration of the corresponding audio data 106*b*. As a result, the embedding generally does not indicate the duration of the audio data 106*b* or the number of feature vectors 110 that should be used to represent the audio data 106*b*. The timing module 124 supplies this information.

The decoder 126 outputs feature vectors one at a time, one for each time step of propagation through the neural network of the decoder 126. The same embedding is provided as input to the decoder 126 at each time step. In addition, the timing module 124 provides the decoder 126 timing information to referred to as a timing signal 124*a*.

The TTS system 102 determines the number of vectors 110 used to represent the acoustic data 106*b* of the training example 106. The TTS system 102 can provide this number in the timing signal 124*a*, to indicate the overall length of the unit whose data is being decoded. The timing signal may also indicate a current time index in the timing signal 124*a* and adjust the time index for each time step. For example, in FIG. 1A, the timing module 124 can provide a first value indicating that the audio data 106*b* being decoded has a length of six frames and thus the decoded output should be spread over a total of six frames. In addition, or as an alternative, the timing signal 124*a* can indicate a current time index of 1, indicating that the decoder 126 is receiving the first input set for the current unit being decoded. The current time index can be incremented for each time step, so that the second set of input for the unit has a time index of 2, the third has a time index of 3, and so on. This information helps the decoder 126 to keep track of the amount of progress through the duration of the speech unit being decoded. In some implementations, the timing module 124 can append the total number of frames in the unit and/or the current time step index to the embedding provided to the decoder 126. The timing information can be provided both when the embedding 118*a* is provided to the decoder 126 as well as when the embedding 118*b* is provided to the decoder 126.

During stage (G), the TTS system 102 obtains output of the decoder 126 produced in response to the selected embedding and the timing signal 124*a*. Like the encoders 114, 116, the decoder 126 can include one or more neural network layers. The neural network in the decoder 126 is trained to provide output indicating feature vectors, and is trained using the embedding information from both outputs of the linguistic encoder 114 and the acoustic encoder 116. Like the neural networks in the linguistic encoder 114 and the acoustic encoder 116, the neural network in the decoder 126 may include one or more LSTM layers, for example, a deep LSTM neural network architecture built by stacking multiple LSTM layers.

The decoder 126 outputs a feature vector 128 for each instance of the embedding 118 the TTS system 102 inputs to the decoder 126. For the training example 106, the TTS system 102 determines that there are six frames in the audio data 106*b* for the training example 106, and so the TTS system 102 provides the selected embedding six times, each time with appropriate timing information from the timing module 124.

During stage (H), the TTS system 102 updates the parameters of the autoencoder network 112, for example, based on differences between the feature vectors 128 output by the acoustic decoder 126 and the feature vectors 110 that describe the audio data 106*b* of the training data 106. The TTS system 102 can train the autoencoder network 112 using back-propagation of errors through time with stochastic gradient descent. A cost, such as a squared error cost, is used at the output of the decoder. Since the output of the encoder 114, 116 is only taken at the end of a speech unit, error back-propagation is typically truncated at speech unit boundaries. Because speech units have differing sizes, truncating on a fixed number of frames may result in weight updates that do not account for the start of a unit. To further encourage the encoders 114, 116 to generate the same embedding an additional term is added to the cost function to minimize the squared error between the embeddings 118*a*, 118*b* produced by the two encoders 114, 116. This joint training allows both acoustic and linguistic information to influence the embedding while creating a space that may be mapped to when given only linguistic information. The neural network weights of the linguistic encoder 114, acoustic encoder 116, and decoder 126 may each be updated through the training process.

The TTS system 102 may update the weights of the neural network in the linguistic encoder 114 or the acoustic encoder 116, depending on which embedding 118*a*, 118*b* was selected by the selector module 122. For example, if the selector module 122 selects the embedding 118*a* output from the linguistic encoder 114, then the TTS system 102 updates parameters of the linguistic encoder 114 and parameters of the decoder 126. If the selector module selects the embedding 118*b*, then the TTS system 102 updates parameters of the acoustic encoder 114 and parameters of the decoder 126. In some implementations, the parameters of the encoders 114, 116, and the decoder 126 are updated for each training iteration, regardless of the selection by the selector module 122. This may be appropriate, for example, when the differences between the embeddings 118*a*, 118*b* of the encoders 114, 116 is part of the cost function being optimized through training.

The operations of stages (A) to (H) illustrate a single iteration of training using a single training example including audio data 106*b* corresponding to a single linguistic unit. The TTS server 102 can repeat the operations of stages (A) to (H) for many other training examples. In some implementations, the TTS system 102 may process each training example 106 from the data storage 104 only once before training the autoencoder network 112 is complete. In some implementations, the TTS system 102 may process each training example 106 from the data storage 104 more than once before the training is complete.

In some implementations, the training process takes advantage of sequence training techniques to train the autoencoder network 112 using sequences of training examples as they occur in actual utterances. For example, where training data includes an utterance of a word or phrase that is represented by multiple linguistic units, the training examples extracted from the utterance can be presented in the order they occur in the utterance. For example, the training example 106 may be the beginning of an utterance of the word "elephant." After training using the training example 106 representing the "/e/" phone of the utterance, the TTS system 102 may continue training using the audio for the "/l/" phone of the same utterance.

The TTS system 102 can continue performing training iterations until the autoencoder network 112 exhibits a level of performance that satisfies a threshold. For example, training may conclude once the TTS system 102 determines that an average cost for training examples is less than a threshold amount. As another example, training may continue until the embeddings 118*a*, 118*b* produced have less than a threshold amount of difference and/or output feature vectors 128 and input feature vectors 110 have less than a threshold amount of difference.

During stage (I), the TTS system 102 builds a speech unit database 132 that associates speech units with embeddings 118*a* produced using the trained linguistic encoder 114. For each speech unit to include in a corpus for unit selection speech synthesis, the TTS system 102 determines the corresponding linguistic unit and provides the appropriate linguistic unit identifier to the linguistic encoder 114 to obtain an embedding for the speech unit. The TTS system 102 determines an index based on the embedding produced by the trained linguistic encoder 114. For example, each of the index values can include one or more of the embeddings output directly from the trained linguistic encoder 114. The linguistic encoder 114 may be trained so that the output of the linguistic encoder directly provides an index value, or a component of an index value, for a linguistic unit. For example, the linguistic encoder 114 may provide embeddings representing phones, and the embeddings may be used as index values associated with phone-sized speech units. As another example, two or more embeddings can be combined to represent speech units of multiple phones. In some implementations, the index values may be otherwise derived from the embeddings.

In some implementations the database 132 stores diphone speech units. Accordingly, the index value for a diphone speech unit may be generated by obtaining an embedding for each of the linguistic units in the diphone speech unit and concatenating the embeddings together. For example, for the diphone speech unit "/he/," the TTS system 102 can determine a first embedding for the phone "/h/" a second embedding for the phone "/e/." The TTS system 102 can then concatenate the first embedding and the second embedding to create a diphone embedding, and add an entry to the database 132 in which the diphone speech unit "/he/" is indexed according to the diphone embedding.

In some implementations, the training performed by the TTS system 102 is arranged to cause distances between the embeddings to be indicative of differences between the acoustic characteristics of the corresponding speech units. In other words, the space in which the embeddings are learned may be constrained so that similar sounding units should be close together while units that sound different should be far apart. This may be achieved through isometric characteristics of embeddings being an additional constraint, so that $L_2$ distances within the embedding space (1) become direct estimates of the acoustic distance between units, and (2), are more consistent across independent network training runs. This helps give the $L_2$ distance between embeddings a meaningful interpretation, since it is later used during synthesis as a measure of target cost, e.g., how well a particular unit matches the linguistic characteristics desired.

A dynamic time warping (DTW) distance between pairs of units can be defined as the sum over the $L_2$ distances between pairs of frames in the acoustic space aligned using the DTW algorithm. The cost function for training the autoencoder network 112 can include a term so that the $L_2$ distance between the embeddings of two units is proportional to the corresponding DTW distance. This may be implemented by training the autoencoder network 112 using batch sizes greater than one. Phones from different sentences in the mini-batch are aligned using DTW to yield a matrix of DTW distances. The corresponding $L_2$ distance matrix is computed between the phones' embeddings. The difference between these two matrices can then be added to the network's cost function for minimization through the training process.

Figure 1B:
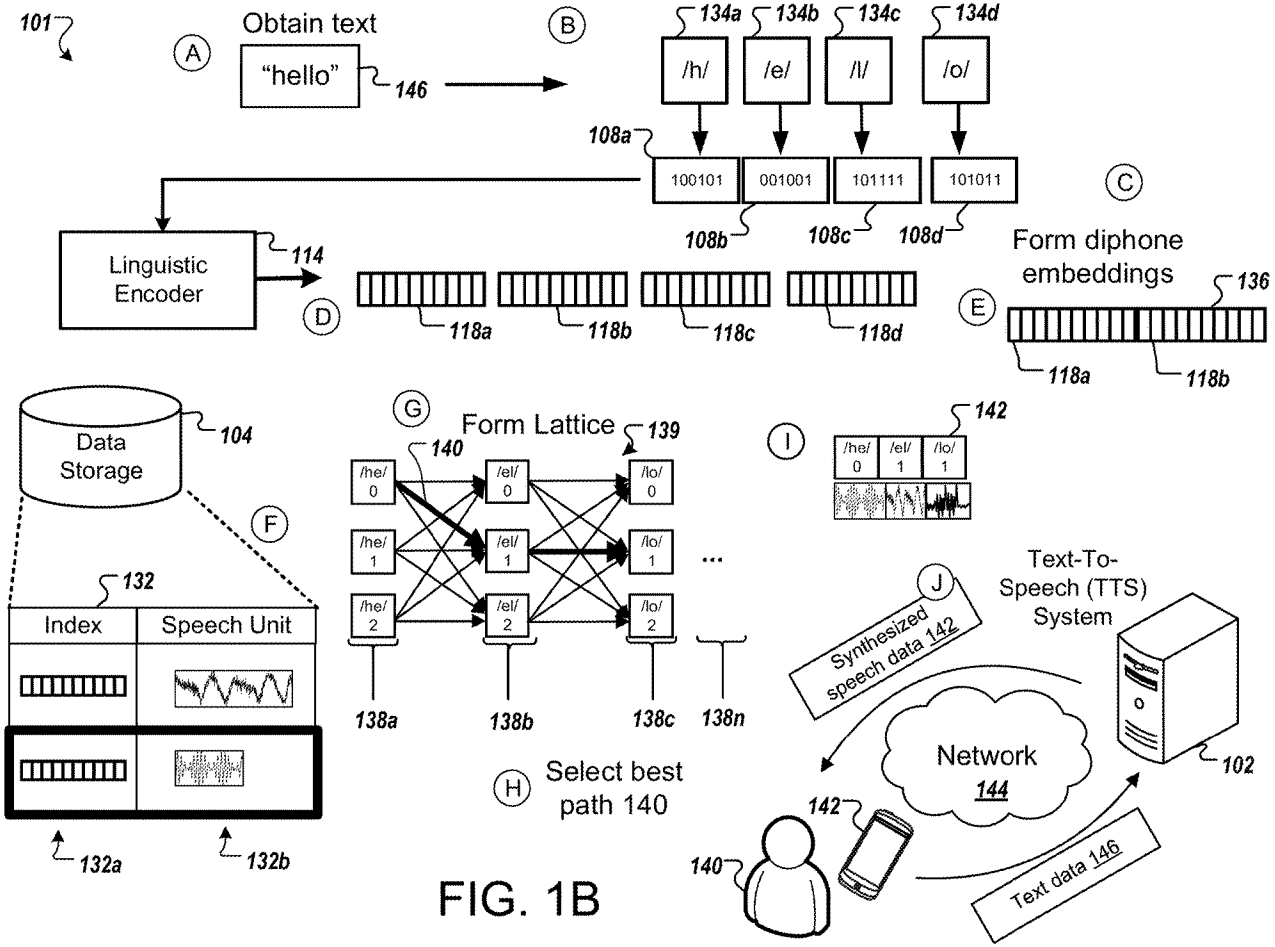

FIG. 1B is a block diagram that illustrates an example of a system 101 for text-to-speech synthesis using an autoencoder network. The operations discussed are described as being performed by the computing system 101, but may be performed by other systems, including combinations of multiple computing systems. FIG. 1B illustrates stages (A) to (J) which illustrate various operations and flows of data that may be occur in the order indicated or in another order.

The computing system 101 includes the TTS system 102, the data storage 104, a client device 142, and a network 144. The TTS system 102 uses the trained linguistic encoder 114 from the autoencoder network 112 of FIG. 1A. The other elements of the autoencoder network 112, such as the acoustic encoder 116, the decoder 126, the timing module 124, and the selector module 122 are not needed. The TTS system 102 may be one or more servers connected locally or over a computer network, such as network 144.

The client device 142 can be, for example, a desktop computer, laptop computer, a tablet computer, a wearable computer, a cellular phone, a smart phone, a music player, an e-book reader, a navigation system, or any other appropriate computing device. In some implementations, the functions described as being performed by the TTS system 102 may be performed by the client device 142 or another system. The network 144 can be wired or wireless or a combination of both and can include the Internet.

In the illustrated example, the TTS system 102 performs text-to-speech synthesis using the linguistic encoder 114 and database 132 described above. Specifically, FIG. 1B illustrates text-to-speech synthesis following training of the autoencoder network 112, as illustrated in FIG. 1A. As mentioned above, only the linguistic encoder 114 portion of the autoencoder network 112 is used for text-to-speech synthesis. The use of the linguistic encoder 114, without the other elements of the autoencoder network 112, allows the text-to-speech synthesis operate quickly and with low computational demands. The ability to use the linguistic encoder 114 to generate index values or vectors for comparison with index values in the database also enhances the efficiency of the process.

During stage (A), the TTS system 102 obtains data indicating text for which synthesized speech should be generated. For example, a client device, such as client device 142, may provide text, such as text data 146, over a network, such as network 144, and request an audio representation of the text data 146 from the computing system 101. As additional examples, text to be synthesized may be generated by a server system, for example, for an output of a digital assistant, as a response to a user request or for other purposes.

Examples of text for which synthesized speech may be desired include text of an answer to a voice query, text in web pages, a short message service (SMS) text message, e-mail messages, social media content, user notifications from an application or device, and media playlist information, to name a few.

During stage (B), the TTS system 102 obtains data indicating linguistic units 134*a*-134*c* corresponding to the obtained text 146. For example, the TTS system 102 may access a lexicon to identify a sequence of linguistic units, such as phones, in a phonetic representation of the text 146. The linguistic units can be selected from a set of context-dependent phones used to train the linguistic encoder 114. The same set of linguistic units used for training can be used during speech synthesis for consistency.

In the illustrated example, the TTS system 102 obtains the text 146 of the word "hello" to be synthesized. The TTS system 102 determines the sequence of linguistic units 134*a*-134*d* that represent the pronunciation of the text 146. Specifically, the linguistic units include linguistic unit 134*a* "/h/", linguistic unit 134*b* "/e/", and linguistic unit 134*c* "/l/," and linguistic unit 134*d* "/o/."

During stage (C), the TTS system 102 determines a linguistic unit identifier corresponding to each of the linguistic units 134*a*-134*d*. For example, the TTS system 102 can determine that the linguistic unit 134*a* "/h/" corresponds to the linguistic unit identifier 108*a*, "100101". The TTS system 102 can determine that the linguistic unit 134*b* "/e/" corresponds to the linguistic unit identifier 108*b*, "001001". Each linguistic unit can be assigned a linguistic unit identifier. As mentioned above, the TTS system 102 may use a lookup table or other data structure to determine the linguistic unit identifier for a linguistic unit. Once the linguistic unit identifiers 108*a*-108*d* are determined, the TTS system 102 inputs each of the linguistic unit identifiers 108*a*-108*d* to the linguistic encoder 114, one by one.

During stage (D), the linguistic encoder 114 outputs an embedding 118*a*-118*d* for each linguistic unit identifier 108*a*-108*d* that is input to the linguistic encoder 114. The embeddings 118*a*-118*d* may each be vectors of the same fixed size. The embeddings may include a combination of acoustic information and linguistic information, according to the training of the linguistic encoder 114.

During stage (E), the TTS system 102 concatenates embeddings 118*a*-118*d* for adjacent linguistic units to create diphone embeddings. The illustrated example shows two single-phone embeddings 118*a*, 118*b* that represent "/h/" and "/e/," respectively, being concatentated to form a diphone embedding 136 representing the diphone "/he/." The TTS system 102 repeats this concatenation process to generate diphone embeddings for each pair of phones, e.g., "/he/," "/el/," and "/lo/". The TTS system 102 creates diphone embeddings 136 to use in retrieving speech units from the database 132, because the speech units 132*b* in the database 132 are diphone speech units in the example of FIG. 1B. Each diphone unit is associated with or indexed by diphone embeddings 132*a* in the database 132, and so generating diphone embeddings 136 for the text 146 facilitates retrieval.

During stage (F), the TTS system 102 retrieves a set of candidate diphone units 132*b* from the database 132 for each diphone embedding 136. For example, the TTS system 102 retrieves a set of k-nearest units from the database 132 for each diphone embedding 136, where k is the predetermined number of candidate diphone units 132*b* to be retrieved from the database 132, e.g., 5, 20, 50, or 100 units. To determine the k-nearest units, the TTS system 102 employs a target cost between the diphone embedding 136 and the diphone embedding 132*a* for each diphone unit in the database 132. The TTS system 102 calculates the target cost as the $L_2$ distance between each diphone embedding 136 and the diphone embedding 132*a* of a diphone unit 132*b* in the database 132. The $L_2$ distance can represent a Euclidean distance or Euclidean metric between two points in a vector space.

During stage (G), the TTS system 102 forms a lattice 139, e.g., a directed graph, using the sets of candidate phoneme units 132*b* that were selected. The TTS system 102 forms a lattice 139 with layers 138*a* through 138*n*. Each layer 138*a*-138*n* of the lattice 139 includes multiple nodes, where each node represents a different candidate diphone speech unit 132*b*. For example, layer 138*a* includes nodes representing the k-nearest neighbors for the diphone embedding 136 representing the diphone "/he/". Layer 138*b* corresponds to the diphone embedding representing the diphone "/el/". Layer 138*c* corresponds to the diphone embedding representing the diphone "/lo/".

During stage (H), the TTS system 102 selects a path through the lattice 139. The TTS system 102 assigns target costs and join costs. The target cost can be based on the $L_2$ distance between the diphone embedding of a candidate speech unit 132*b* with respect to a diphone embedding generated for a diphone from the text 146 to be synthesized. Join costs can be assigned to path connections between nodes representing speech units, to represent how well the acoustic properties of two speech units represented in the lattice 139 will join together. Costs for different paths through the lattice 139 can be determined using, e.g., a Viterbi algorithm, and the TTS system 102 selects the path with the lowest cost. The Viterbi algorithm seeks to minimize the overall target cost and join costs through the lattice 139. A path 140 with the lowest cost is illustrated with a dark line.

In order to synthesize a new utterance, the candidate diphone embeddings 132*b* may join in sequence. However, the candidate diphone embeddings 132*b* may join to sound human like and not include spurious glitches. In order to avoid this circumstance, the join cost needs to be minimized during the Viterbi search. The join cost is responsible for predicting how well two candidate diphone embeddings 132*b* may join in sequence, seeking to avoid any perceptible discontinuities. In order to minimize these join costs, the TTS system 102 seeks to determine the following characteristics in the lattice 139. The TTS system 102 seeks to determine a spectral match between consecutive candidate diphone embeddings 132*b* corresponding to consecutive layers 138 in the lattice 139. The TTS system 102 seeks to match energy and loudness between consecutive candidate diphone embeddings 132*b* corresponding to consecutive layers 138. The TTS system 102 seeks to match in fundamental frequencies $f_0$ between consecutive candidate diphone embeddings 132*b* corresponding to consecutive layers 138. The TTS system 102 returns path 140 from the Viterbi search with the lowest join cost and lowest target costs.

During stage (I), the TTS system 102 produce synthesized speech data 142 by concatenating the speech units in the selected path 140 that corresponds to the lowest cost. For example, path 140 returns three candidate diphone embeddings 132*b* corresponding to each layer 138 in the lattice 139. The TTS system 102 then concatenates the three candidate diphone embeddings 132*b* to synthesized speech data 142. For example, the TTS system 102 concatenates the selected diphone speech units represented along path 140, "/he/", "/el/", and "/lo/," to form the synthesized speech data 142 that represents an utterance of the word "hello".

During stage (J), the TTS system 102 outputs the synthesized speech data 142 to a client device 142 over network 144. The client device 142 can then play the synthesized speech data 142, e.g., with a speaker of the client device 142.

Figure 2:
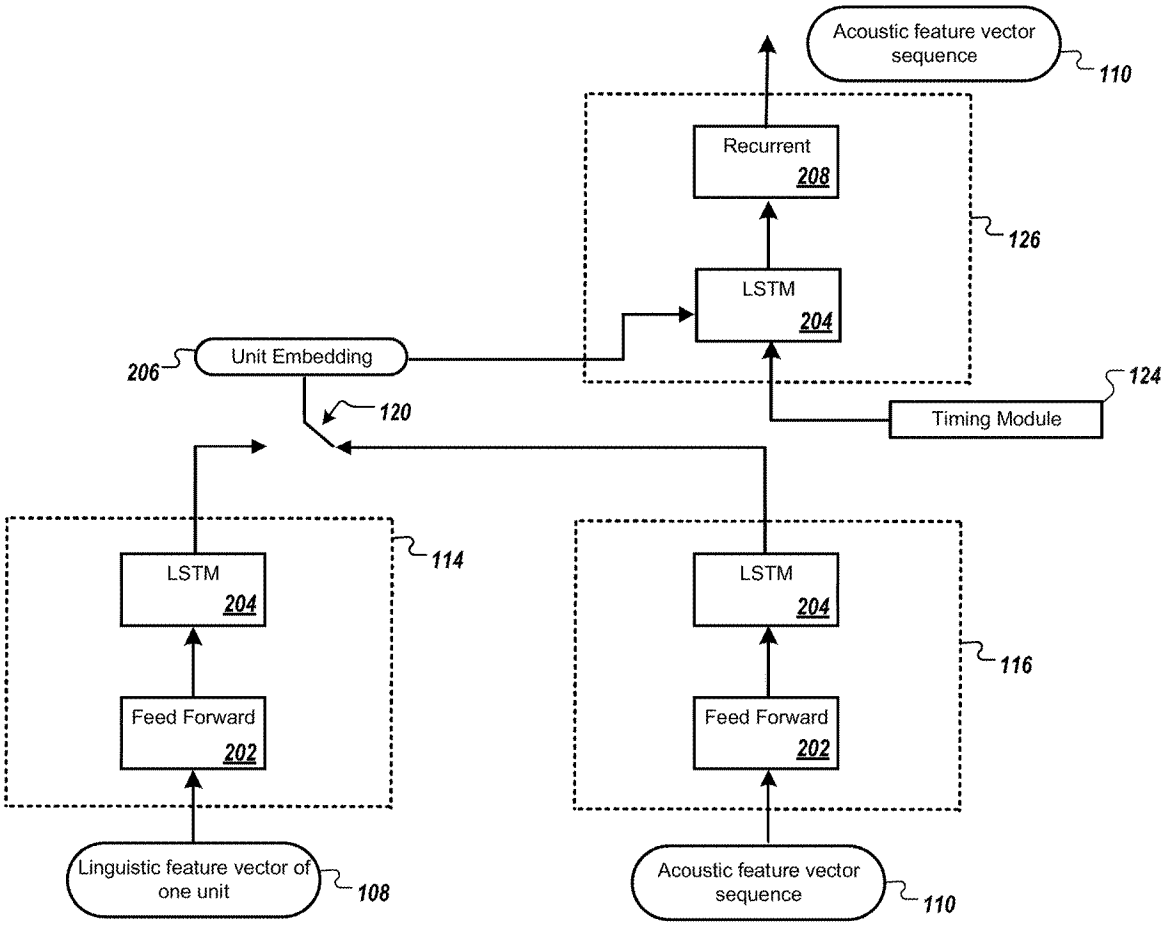
FIG. 2 is a block diagram that illustrates an example of a neural network autoencoder.

FIG. 2 is a block diagram that illustrates an example of a neural network system. FIG. 2 illustrates examples of neural network elements of the autoencoder network 112 discussed above. As described in FIG. 1A, the TTS system 102 inputs data indicating a linguistic unit, e.g., a linguistic unit identifier 108, to the linguistic encoder 114. Additionally, the TTS system 102 inputs an acoustic feature vector sequence or feature vectors 110 to the acoustic encoder 202. In some implementations, the linguistic encoder 114 and the acoustic encoder 116 both include a feed forward neural network layer 202 and a recurrent neural network layer 204. In some implementations, the feed forward neural network 202 is omitted in one or both of the linguistic encoder 114 and the acoustic encoder 116.

In the example, the linguistic encoder 114 and the acoustic encoder 116 also include a recurrent neural network 204. The recurrent neural network 204 may represent one or more LSTM layers. The neural networks 204 may have the same or different structure, e.g., the same or different number of layers or number of nodes per layer. Each instance of neural network 204 shown in FIG. 2 will have different parameter values in response to the training process. In some implementations, the recurrent neural network architecture can be built by stacking multiple LSTM layers.

In the example, the decoder 126 includes a recurrent neural network 204 with one or more LSTM layers. In some implementations, the decoder 126 also includes a standard recurrent neural network 208 without LSTM layers. The standard recurrent neural network 208 may help smooth the output and result in patterns that better approximate the features of human speech.

In general, the advances that neural networks brought to generative text-to-speech (TTS) synthesis have not yet propagated to unit-selection methods, which are still the preferred choice when computational resources are neither scarce nor excessive. A neural-network model that gracefully tackles the issue and delivers substantial quality improvements is discussed herein. The model employs a sequence-to-sequence long short term memory (LSTM)-based autoencoder that compresses the acoustic and linguistic features of each unit to a fixed-size vector, referred to as an embedding. Unit-selection is facilitated by formulating the target cost as an $L_2$ distance in the embedding space. In open-domain speech synthesis, the method has shown to improve Mean-Opinion-Score (MOS) of naturalness in some situations. Furthermore, the new TTS system significantly increases text-to-speech synthesis quality while retaining low computational cost and latency.

Generative text-to-speech has improved over the past few years and challenges traditional unit-selection approaches both at the low-end and the high-end parts of the market where the computational resources are scarce and excessive, respectively. At the low-end market, such as TTS embedded on a mobile device, unit-selection is challenged by statistical parametric speech synthesis (SPSS), while at the high-end market, unit-selection is challenged by advanced approaches like WaveNet. However, SPSS is not preferred over unit-selection for voices based on highly-curated speech corpus, while WaveNet is not fast enough to be used in practice for the average use-case. Furthermore, the ability of unit-selection to yield studio-level quality for limited-domain TTS remains largely unchallenged. This creates a time window where unit-selection methods can still deliver higher quality to the market.

Improving unit-selection TTS using neural networks has so far yielded results that are not as impressive as those obtained for SPSS when the transition from hidden Markov models (HMMs) to neural networks was made.

For example, it is computationally expensive to run an SPSS network with a bidirectional long short-term memory (bLSTM) network to predict a vocoder parameter sequence for each unit. This predicted parameter sequence is compared to the vocoder parameter sequence of the units in the database by various metrics to determine a target cost.

A more efficient approach is to construct a fixed-size representation of the variable-size audio units, hereafter referred to as a (unit-level) embedding. Previous methods take frame-level embeddings of linguistic and acoustic information from the intermediate layers of a deep neural network (DNN) or a long short-term memory (LSTM) network and use them to construct a unit-level embedding. This is made by segmenting each unit in to four parts and taking the short-term statistics (means, variances) of each part. Some systems, the frame-level embeddings are made by sampling at fixed-points of a normalized time axis. In these cases, the fixed-size representations are constructed via some heuristics rather than being learned through training. From a modelling perspective, such heuristic approaches limit the effectiveness of the embedding both in terms of compactness (yields larger unit-embeddings) as well as reconstruction error (information is lost both through sampling or taking short-term statistics).

Using a sequence-to-sequence LSTM-based autoencoder represents a significant improvement to unit-selection technologies. With this approach, a traditional HMM is not needed. In particular, a network with a temporal bottleneck layer can represent each unit of the database with a single embedding. An embedding may be generated so that the embedding satisfies some basic conditions for it to be useful for unit-selection. For example, a unit-selection system may operate to satisfy some or all of the following constraints: to encode variable-length audio to a fixed-length vector representation; an embedding represents the acoustics; linguistic features are inferred from each embedding; a metric of the embedding space is meaningful; and, similar sounding units are close together while units that are different are far apart. The autoencoder techniques discussed in this application can be implemented to satisfy these constraints.

In some implementations, parametric speech synthesis employs sequence-to-sequence autoencoders to compress the frame-level acoustic sequence onto a unit-level acoustic embedding. Unit-selection is facilitated by formulating the target cost as the $L_2$ distance in the embedding space. The use of $L_2$ instead of Kullback-Leibler distance reduces the computational cost significantly by recasting preselection as a k-nearest neighbor problem.

In some implementations, the unit embeddings in a TTS database are learned automatically and deployed in a unit-selection TTS system.

Typically, both acoustic (speech) and linguistic (text) features are available during training but only the linguistic features are present at run-time. The first challenge is to design a network that is able to exploit both at the input of the network during training but still works correctly at run-time without acoustic features. This is desirable for unit-selection because it is important that the embedding represents the acoustic content of the unit: since the linguistic features alone are insufficient to describe the full variability that exists in each unit, without the acoustics it is likely that the network will learn a smoothed or average embedding. Furthermore, if the learned embeddings are unconstrained then they can vary hugely between different training sessions depending upon the network's initialization. Such variability can pose problems for unit-selection when the target cost, estimated as the distance $L_2$ between embeddings, is combined with join costs in the Viterbi search for the best path.

Embeddings can be learned using a sequence-to-sequence autoencoder network consisting of LSTM units. For example, the network can include two encoders: the first encoder encodes the linguistic sequence, which includes a single feature vector for each (phone- or diphone-sized) unit. The first encoder can be a multilayer recurrent LSTM network that reads one input linguistic feature vector and outputs one embedding vector for every unit. The second encoder encodes the acoustic sequence of each unit. The second encoder can also be a recurrent multilayer LSTM network. The second encoder's input is the sequence of parameterized acoustic features of a complete unit and the second encoder outputs one embedding vector upon seeing the final vector of the input sequence. This is the temporal bottleneck mentioned above, where information from multiple time frames is squeezed to a single low dimensional vector representation.

The embedding outputs of the two encoders are the same size, e.g., the same number of values. A switch is inserted so that the decoder may be connected to either the acoustic or the linguistic encoder. During training, the switch is set randomly for each unit according to some fixed probability. This arrangement varies whether the decoder receives the embedding of the first encoder or the second encoder for the training examples, and helps the embeddings of the different encoders converge toward a similar representation over the course of training, even though the two encoders receive different types of inputs.

A decoder is given an embedding as input and trained to estimate the acoustic parameters of the speech from the embedding. The decoder's topology includes input composed of the embedding vector duplicated enough times to match the number of frames in the unit plus a coarse coding timing signal. The coarse coding timing signal is appended to each frame, which tells the network how far the decoder has progressed in decoding the speech unit.

The network can be trained using back-propagation through time with a stochastic gradient descent. Additionally, the network can use a squared error cost at the output of the decoder. Since the output of the encoder is only taken at the end of a unit, error back-propagation is truncated at unit boundaries. Specifically, the error back-propagation truncates on a fixed number of frames, which may result in weight updates that do not account for the start of a unit. To encourage the encoders to generate the same embedding, an additional term is added to the cost function to minimize the squared error between the embeddings produced by the two encoders. This joint training allows both acoustic and linguistic information to influence the embedding while creating a space that may be mapped when given only linguistic information. In some implementations, linguistic information is not incorporated in the embedding because the linguistic information is learned entirely by the autoencoder: The linguistic encoder is trained separately after the acoustic encoder has been finalized.

One feature of unit-selection systems is the ability to weight the relative importance of the different information streams, spectrum, aperiodicity, $F_0$, voicing and duration. Using a single decoder will result in an embedding that encodes all these streams to the embedding making it impossible to reweight the streams. So that reweighting may be achieved, the embedding is partitioned to separate streams and each partition is connected to its own decoder that is solely responsible for predicting the features of that stream. Thus, to allow reweighting, the decoder 126 indicated above may include multiple component decoders each trained to output information from one of the different information streams.

In some implementations, isometric embeddings may be used as an additional constraint in unit-selection systems. By doing this, $L_2$ distances within the embedding space become direct estimates of the acoustic distance between units. Additionally, using isometric embeddings in unit-selection systems maintains consistent $L_2$ distances across independent network training runs. With this constraint, a meaningful interpretation is given to $L_2$ distances for target costs and join costs in unit-selection systems.

Dynamic time warping (DTW) distance is a distance between pairs of units as the sum over the $L_2$ distances between pairs of frames in the acoustic space aligned using the DTW algorithm. In some implementations, a term may be added to the network's cost function such that the $L_2$ distance between the embedding representations of two units is proportional to the corresponding DTW distance. This is implemented by training the network using batch sizes greater than one. Phones from different sentences in the mini-batch are aligned using DTW to yield a matrix of DTW distances. The corresponding $L_2$ distance matrix is computed between the embeddings of the phones. The difference between these two matrices is added to the network's cost function for minimization.

When building a voice, the embeddings of every unit in the voice training data are saved in a database. At run-time, the linguistic features of the target sentence are fed through the linguistic encoder to get the corresponding sequence of target embeddings. For each of these target embeddings, k-nearest units are preselected from the database. These preselected units are placed in a lattice and a Viterbi search is performed to find the best sequence of units that minimizes the overall target and join costs. The target cost is calculated as the $L_2$ distance from the target embedding vector, predicted by the linguistic encoder, to the unit's embedding vector stored in the database.

In one example, the training data included around 40,000 sentences recorded from a single American English speaker in a controlled studio environment. In order to experiment, audio was down-sampled to 22,050 Hz. The speech may be parameterized as 40 Mel-scaled cepstral coefficients, 7 band aperiodicities, log $F_0$, and a Boolean indicating voicing. About 400 sentences may be chosen at random to be held out as a development set to check that the networks do not over-train.

Subjective evaluation of unit-selection systems is particularly sensitive to the selection of test-set utterances because the MOS of each utterance depends on how well the utterance matches the statistics of the audio corpus. To mitigate this, First, the unit-selection system shifts the statistical power of the listening test towards utterance coverage by having only one rating per utterance and 1,600 utterances. Second, the unit-selection system samples the test utterances directly from anonymized TTS logs using uniform sampling on the logarithmic frequency of the utterances. This ensures that the test-set is representative of the actual user experience and that the MOS results are not biased towards the head of the Zipf-like distribution of the utterances.

Low-order embeddings are surprisingly informative. The unit-selection system can reconstruct highly intelligible medium quality parametric speech with only 2 or 3 parameters per phone, rendering the proposed method suitable for ultra-low-bit-rate speech coding. Further, the embeddings are meaningful in the sense that adjacent points in the embedding space correspond to phonemes that have identical or very similar contexts. Thus, the proposed method is an excellent way to visualize speech.

Preliminary informal listening tests showed that phoneme-based embeddings perform better than diphone-based ones. This can be attributed to the fact that a phone is a much more compact abstraction of a unit than a diphone. In other words, the lower cardinality of the phone set improves the efficiency of the corresponding embedding.

In some implementations, two systems may be tested: unpartitioned and partitioned. The two systems differ only on whether the information streams that describe unit acoustics (spectra, aperiodicity, log $F_0$, voicing) are embedded jointly or separately. Specifically, unpartitioned unit embeddings consist of a single vector that describe spectra, aperiodicity, log $F_0$ and voicing, while partitioned unit embeddings consist of a super-vector of four vectors each individually representing spectra, aperiodicity, log $F_0$ and voicing. In both cases, phone duration is embedded separately from the other streams. The MOS-Naturalness and confidence intervals of the two systems for several target cost weights varying from 0.5 to 2.0, as well as the baseline HMM-based system. However, given that all unpartitioned systems saturate around the maximum MOS level of 4.5 that raters assign to recorded speech, it is fair to claim that limited domain speech synthesis reached recording quality.

Open-domain results show that all proposed systems outperform the baseline; in most cases, substantially enough to be statistically significant without further AB testing. The best system, unpartitioned with a target cost weight of 1.5, outperforms the baseline by an impressive 0.20 MOS. The improvement is statistically significant since the confidence intervals do not intersect.

Further experiments of a similar nature suggest that isometric training neither improves nor degrades MOS in unit-selection framework: the MOS naturalness scores obtained with isometric embeddings lay within the error-bars of the unpartitioned system.

The second experiment explores the relationship between MOS-Naturalness and model size. The best system from the previous experiment, unpartitioned with target cost weight of 1.50, is evaluated for LSTM layers with 16, 32, 64, 128, and 256 nodes per layer. A maximum size of 64 dimensions is used for each phone-embedding, while the (unit) diphone-embedding is constructed by concatenating two phone embeddings and further restricting the number of dimensions to 64 using Principal Component Analysis for computational reasons. For example, 64 LSTM nodes per layer are often sufficient in terms of performance and quality. The confidence intervals indicate that the proposed embeddings indeed outperform the baseline with statistical significance, for open-domain as well as limited-domain TTS synthesis.

The third experiment compares the unit-selection system to WaveNet in open-domain TTS (WebAnswers) using 1,000 randomly selected utterances from anonymized logs. The results yields a statistically significant improvement of 0.16 MOS over the HMM-based baseline while it has a 0.13 MOS difference with the corresponding 24 kHz WaveNet. The difference is much smaller when considering the much faster 16 kHz WaveNet. Thus, the proposed method is in-between the baseline and the best reported TTS in terms of quality with a reduction in computational load.

Figure 3:
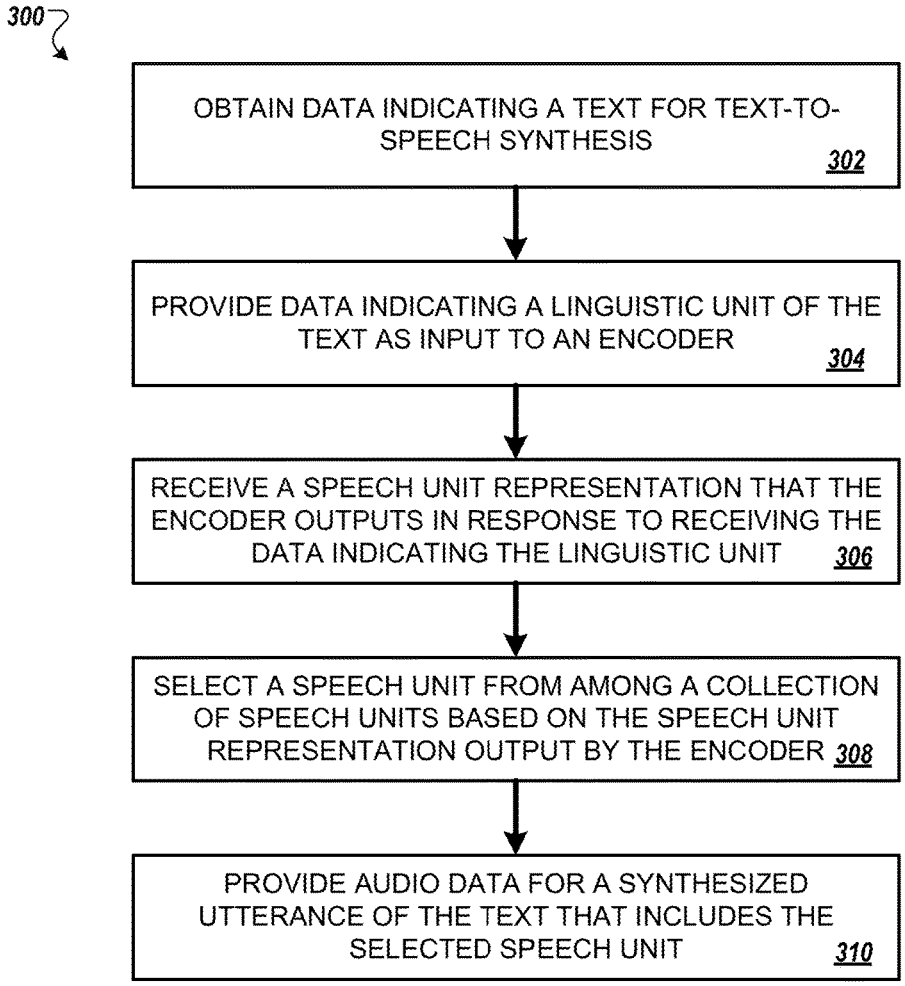
FIG. 3 is a flow diagram that illustrates an example of a process for text-to-speech synthesis.

FIG. 3 is a flow diagram that illustrates an example of a process 300 for text-to-speech synthesis. The process 300 may be performed by one or more computers, such as one or more computers of the TTS system 102.

In the process 300, the one or more computers obtain data indicating a text for text-to-speech synthesis (302). The data indicating text to be synthesized may be received from stored data, from a client device over a network, from a server system, etc. For example, the data may include text of an answer to a voice query, text in web pages, an SMS text message, e-mail messages, social media content, a user notification, or media playlist information, to name a few examples.

The one or more computers provide data indicating a linguistic unit of the text as input to an encoder (304). For example, the data may include an identifier or code representing a phonetic unit, such as a phone. For example, for the text "hello," the one or more computers may indicate each linguistic unit, e.g., "/h/", "/e/", "/l/", and "/o/" by providing a linguistic identifier for each of these units. Additionally, the data can indicate linguistic unit information that is selected from a set of context-dependent phones.

The encoder can be configured to output speech unit representations indicative of acoustic characteristics based on linguistic information. The encoder can be configured to provide speech unit representations (e.g., embeddings) learned through machine learning training. Each of linguistic units can be assigned a linguistic identifier. The one or more computers may use a lookup table or another data structure to determine the linguistic unit identifier for each linguistic unit. Once the one or more computers determines a linguistic unit identifier for each linguistic unit, the one or more computers provides each linguistic unit identifier to the linguistic encoder 114, one by one.

In some implementations, the encoder comprises a trained neural network having one or more long-short-term memory layers. The encoder can include a neural network that was trained as part of an autoencoder network that includes the encoder, a second encoder, and a decoder. In this autoencoder network the encoder is arranged to produce speech unit representations in response to receiving data indicating linguistic units. The second encoder is arranged to produce speech unit representations in response to receiving data indicating acoustic features of speech units. The decoder is arranged to generate output indicating acoustic features of speech units in response to receiving speech unit representations for the speech units from the encoder or the second encoder. The encoder, the second encoder, and the decoder can be trained jointly, and the encoder, the second encoder, and the decoder can each include one or more long short-term memory layers. In some implementations, the encoder, the second encoder, and the decoder are trained jointly using a cost function configured to minimize both (i) differences between acoustic features input to the second encoder and acoustic features generated by the decoder and (ii) differences between the speech unit representations of the encoder and the speech unit representations of the second encoder.

The one or more computers receive a speech unit representation that the encoder outputs in response to receiving the data indicating the linguistic unit as input to the encoder (306). In particular, the encoder, such as the linguistic encoder 114, may be configured to output one speech unit representation in response to receiving one linguistic unit identifier for a linguistic unit. The encoder can be trained to infer speech unit representations from linguistic unit identifiers, wherein the speech unit representations output by the encoder are vectors that have a same fixed length. The speech unit representations output by the encoder may be vectors of the same fixed size yet, represent speech units that have various durations.

In some implementations, each speech unit representation may include a combination of acoustic information and linguistic information. Thus, in some implementations, in response to purely linguistic information, the linguistic encoder can produce a speech unit representation that indicates acoustic properties that would be present in a spoken form of one or more linguistic units, while optionally also indicating linguistic information such as what the corresponding one or more linguistic units are.

The one or more computers select a speech unit to represent the linguistic unit (308). The speech unit can be selected from among a collection of speech units based on the speech unit representation output by the encoder. The speech units can be, for example, recorded audio samples or other data that defines the sound of a speech unit. The selection can be made based on a vector distances between (i) a first vector that includes the speech unit representation output by the encoder and (ii) second vectors corresponding to speech units in the collection of speech units. For example, the one or more computers can identify a predetermined quantity of second vectors that are nearest neighbors for the first vector, and selecting, as a set of candidate speech units, a set of speech units corresponding to the identified predetermined quantity of second vectors that are nearest neighbors for the first vector.

In some implementations, the one or more computers may concatenate each speech unit representation (e.g., embedding) output corresponding to adjacent linguistic unit identifiers from the encoder to create diphone speech unit representations. For example, the encoder may output single-phone speech unit representations for each linguistic unit, such a single phone speech unit representation for each of the "/h/" an "/e/" linguistic units. The one or more computers may concatenate the two single-phone speech unit representations to form a diphone speech unit representation representing the diphone, such as "/he/." The one or more computers repeats the concatenation process to generate diphone speech unit representation representations for each pair of phones output from the encoder, e.g., "/he/," "/el/," and "/lo/". The one or more computers create diphone speech unit representations to use in retrieving and selecting speech units from the database when the speech units in the database are diphone speech units. Each diphone speech unit in the database is indexed by a diphone speech unit representation which allows for facilitating retrieval from the database. Of course, the same techniques can be used to store and retrieve speech units representing other numbers of phone, e.g., single phone speech units, speech units for less than one phone, triphone speech units, and so on.

As a result, in some implementations, the speech unit representation for the linguistic unit is a first speech unit representation for a first linguistic unit. To select the speech unit, the one or more computers can obtain a second speech unit representation for a second linguistic unit that occurs immediately before or after the first linguistic unit in a phonetic representation of the text; generate a diphone unit representation by concatenating the first speech unit representation with the second speech unit representation; and select, to represent the first linguistic unit, a diphone speech unit identified based on the diphone speech unit representation.

The one or more computers provide audio data for a synthesized utterance of the text that includes the selected speech unit (310). To provide the synthesized utterance of the text that includes the selected speech unit, the one or more computers retrieves a set of candidate diphone speech units from the database for each diphone speech unit representation. For example, the one or more computers retrieves a set of k-nearest units from the database for each diphone speech unit representation, where k is the predetermined number of candidate diphone units to be retrieved from the database, e.g., 5, 20, 50, or 100 units, to name a few. To determine the k-nearest units, the one or more computers evaluates a target cost between the diphone speech unit representation output from the encoder and the diphone speech unit representation indexing the diphone speech unit in the database. The one or more computers calculates the target cost as, for example, the $L_2$ distance between each concatenated diphone speech unit representation output from the encoder and the diphone speech unit representation indexing the diphone speech unit in the database. The $L_2$ distance can represent a Euclidean distance or Euclidean metric between two points in a vector space. Other target costs may additionally or alternatively be used.

In some implementations, the one or more computers form a lattice using the set of candidate linguistic units that were selected from the database. For example, the lattice may includes one or more layers, where each layer includes multiple nodes, and each node represents candidate diphone speech units from the database that are the k-nearest units for a particular diphone speech unit representation. For example, the first layer includes nodes that represent the k-nearest neighbors for the diphone speech unit representation that represents the diphone "/he/". Next, the one or more computers select a best path through the lattice using target costs and join costs. The target cost can be determined from the $L_2$ distance between the diphone speech unit representation of a candidate speech unit from the database with respect to a diphone speech unit representation generated for a diphone. The one or more computers can assign join costs to path connections between nodes representing speech units, to represent how well the acoustic properties of two speech represented in the lattice join together. The one or more computers can then use algorithms, such as the Viterbi algorithm, to minimize the overall target cost and join cost through the lattice, and the path with the lowest cost is selected.

The one or more computers then produce synthesized speech data by concatenating the speech units from the lowest cost path selected from the lattice. For example, the one or more computers concatenate the selected diphone speech units represented from the lowest cost path, "/he/", "/el/", and "/lo/," to form the synthesized speech data that represents the utterance of the word "hello." Lastly, the one or more computers output the synthesized speech data to a client device over a network.

Figure 4:
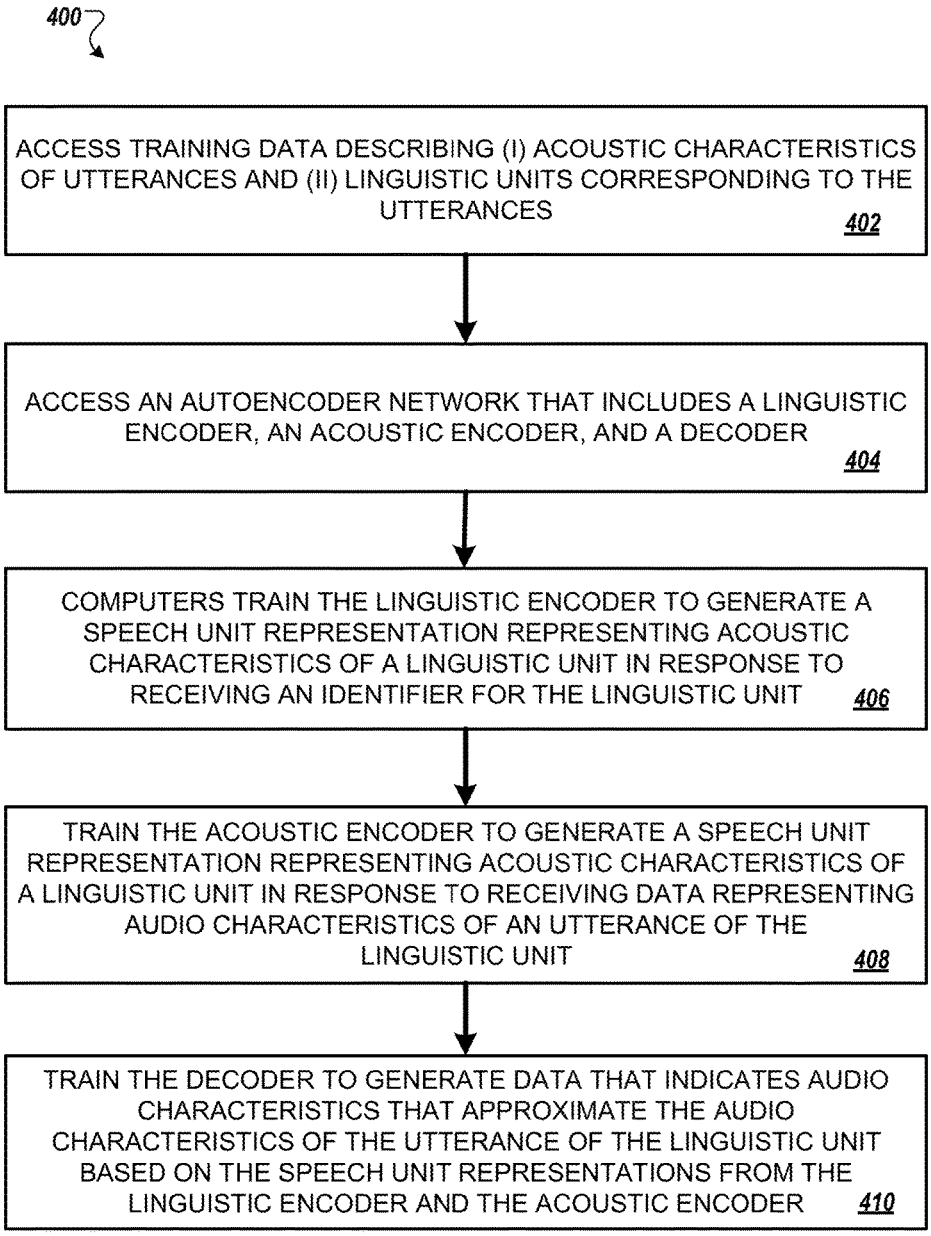
FIG. 4 is a flow diagram that illustrates an example of a process for training an autoencoder.

FIG. 4 is a flow diagram that illustrates an example of a process 400 for training an autoencoder. The process 400 may be performed by one or more computers, such as one or more computers of the TTS system 102.

In the process, the one or more computers access training data describing (i) acoustic characteristics of utterances and (ii) linguistic units corresponding to the utterances (402). The acoustic characteristics of utterances may include audio data, e.g., data for an audio waveform or other representations of audio, and the acoustic characteristics may include vectors of acoustic features derived from the audio data. The linguistic units may include phonetic units, such as phone, diphones, syllables, or other phonetic units. The linguistic units may be context-dependent, for example, context-dependent phones that each represent a particular phone that follows one or more prior phones and is followed by one or more subsequent phones.

The one or more computers may access a database to retrieve the training data, such as a linguistic label and an acoustic label. For example, the linguistic label can represent an "/h/" phone, and the acoustic label represents audio characteristics corresponding to the "/h/" phone. The one or more computers can use a lexicon to identify a sequence of linguistic units, such as phones, for text transcriptions stored in the database. The one or more computers can align the sequence of linguistic units with the audio data and extract audio segments representing individual linguistic units.

The one or more computers determine a linguistic unit identifier corresponding to the retrieved linguistic label. The linguistic unit identifiers can be provided as input to the linguistic encoder, such as linguistic encoder 114. The mapping between linguistic units and their corresponding linguistic unit identifiers can remain consistent during training and also during use of the trained linguistic encoder to synthesize speech, so each linguistic unit identifier consistently identifies one single linguistic unit. In one example, the one or more computers determine the linguistic identifier associated with the linguistic unit as indicated by the linguistic label "/h/" to be a binary vector "101011." The one or more computers provide the linguistic unit identifier one by one to the autoencoder network.

Additionally, the one or more computers extract feature vectors that indicate acoustic characteristics from the retrieved audio data to provide to the autoencoder network, one by one.

The one or more computers access an autoencoder network that includes a linguistic encoder, an acoustic encoder, and a decoder (404). For example, the one or more computers can provide data indicating the linguistic unit and data indicating the acoustic features of the acoustic data from the training example as input into the autoencoder network. The one or more computers can input the linguistic unit identifier to the linguistic encoder of the autoencoder network and input the acoustic feature vectors to the acoustic encoder, one feature vector at a time.

The linguistic encoder 114 and the acoustic encoder 116 may each include one or more neural network layers. For example, each of the encoders 114 and 116 may include recurrent neural network elements, such as one or more long short-term memory (LSTM) layers. In addition, each encoder 114 and 116 may be a deep LSTM neural network architecture built by stacking multiple LSTM layers.

The one or more computers train the linguistic encoder to generate a speech unit representation representing acoustic characteristics of a linguistic unit in response to receiving an identifier for the linguistic unit (406). For example, the output of the neural network in the linguistic encoder 114 can be trained to provide an embedding or a fixed-size speech unit representation. In particular, the linguistic encoder 114 outputs a speech unit representation, such as an embedding, in response to the one or more computers providing input to the linguistic encoder. The speech unit representation is output from the linguistic encoder 114 once the linguistic unit identifier has propagated through each LSTM layer of the neural network in the linguistic encoder 114.

The one or more computers train the acoustic encoder to generate a speech unit representation representing acoustic characteristics of a linguistic unit in response to receiving data representing audio characteristics of an utterance of the linguistic unit (408). For example, the output of the neural network in the acoustic encoder 116 can be trained to provide an output of a fixed-size speech unit representation or embedding of the same size as the output of the linguistic encoder 114. In particular, the acoustic encoder 116 may receive multiple feature vectors from the retrieved audio data and provide an output speech unit representation once the last feature vector propagates through the neural network of the acoustic encoder 116. The one or more computers may disregard the outputs of the acoustic encoder 116 until the last of the feature vectors has propagated through the layers of the neural network elements. At the last feature vector in the sequence, the acoustic encoder 116 has determined the full length of the feature vector sequence and has received all of the applicable acoustic information for the current speech unit, and so can most accurately produce the output representing that speech unit.

The one or more computers train the decoder to generate data that indicates audio characteristics that approximates the audio characteristics of the utterance of the linguistic unit based on the speech unit representations from the linguistic encoder and the acoustic encoder (410). The decoder attempts to recreate a sequence of feature vectors based on the received speech unit representations from the linguistic encoder 114 and the acoustic encoder 116. The decoder outputs feature vectors one at a time, one for each step as data propagates through the neural network of the decoder. The neural network in the decoder is similar to the neural networks of the linguistic encoder 114 and the acoustic encoder 116 in that the decoder can include one or more neural network layers. Additionally, the neural network in the decoder may include one or more LSTM layers, for example, a deep LSTM neural network architecture built by stacking multiple LSTM layers. The neural network in the decoder, such as decoder 126, is trained to provide output indicating feature vectors using the embedding information from either of the outputs of the linguistic encoder 114 and the acoustic encoder 116.

The process 400 can involve switching between providing speech unit representations from the acoustic encoder and the linguistic encoder to the decoder. This switching can be done randomly or psuedorandomly for each training example or for groups of training examples. As discussed above, varying which encoder's output is passed to the decoder can help align the outputs of the encoder to produce the same or similar representations for the same speech unit, even though the two encoders may receive information indicating entirely different aspects of the speech unit (e.g., purely acoustic information provided to the acoustic encoder, and purely linguistic information provided to the linguistic encoder). For example, a selector module may select whether the decoder should receive the speech unit representation from the linguistic encoder 114 or receive the speech unit representation from the acoustic encoder 116. The selector module randomly determines, for each training example, whether the decoder will receive the output of the acoustic encoder or the linguistic encoder, according to a fixed probability. The switching between outputs of the encoders 114, 116 facilitates training of the linguistic encoder 114. In particular, the use of a shared decoder, such as decoder 126 shown in FIG. 1A, allows the one or more computers to minimize the differences between the speech unit representations between the linguistic encoder 114 and the acoustic encoder 116. Additionally, the one or more computer switching between which encoder 114, 116 provides the speech unit representation to the decoder, causes the linguistic encoder to produce speech unit representations that are indicative of audio characteristics.

During the training process, the one or more computer updates the parameters of the autoencoder network based on differences between the feature vectors output by the decoder 126 and the feature vectors that describe the audio data retrieved from the database for training. For example, the one or more computers can train the autoencoder network using back-propagation of errors through time with stochastic gradient descent. A cost, such as a squared error cost, may be added to the output of a decoder. Additionally, the one or more computers may add an additional term to the cost function to minimize the squared error between the speech unit representations produced by the two encoders 114, 116. This joint training allows both acoustic and linguistic information to influence the training process and the speech unit representation ultimately generated, while creating a space that may be mapped to when given only linguistic information. The neural network weights of the linguistic encoder 114, acoustic encoder 116, and decoder 126 may each be updated through the training process.

The one or more computers may update weights of the neural network in the linguistic encoder 114, the acoustic encoder 116, and/or the decoder 126, using the speech unit representation that was selected by the selector module. The parameters of the encoders 114, 116 and the decoder 126 may be updated for each training iteration, regardless of the selection by the selector module. In addition, this may appropriate when the differences between the embeddings provided by the encoders 114, 116 is part of the cost function being optimized through training.

After training, the one or more computers may provide the linguistic encoder for use in text-to-speech synthesis, e.g., as the encoder used in the process 300. The linguistic encoder, or alternatively the acoustic encoder, may also be used to produce index values or index vectors for each speech unit in a database, to be used for matching against speech unit representations produced when speech is synthesized.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory program carrier for execution by, or to control the operation of, data processing apparatus. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. The computer storage medium can be a machine-readable storage device, a machine-readable storage substrate, a random or serial access memory device, or a combination of one or more of them. The computer storage medium is not, however, a propagated signal.

Figure 5:
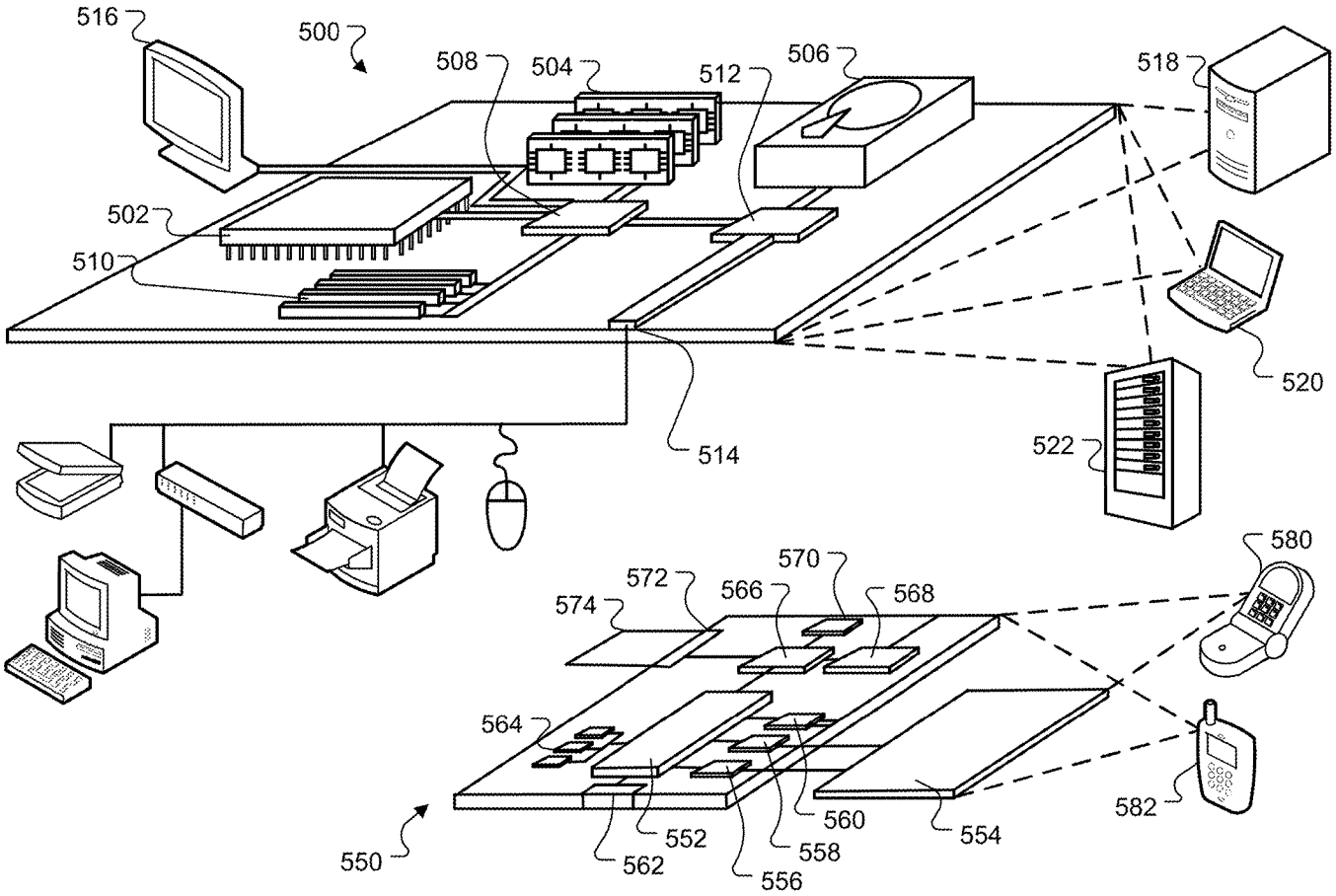
FIG. 5 shows an example of a computing device and a mobile computing device.

FIG. 5 shows an example of a computing device 500 and a mobile computing device 550 that can be used to implement the techniques described here. The computing device 500 is intended to represent various forms of digital computers, such as laptops, desktops, workstations, personal digital assistants, servers, blade servers, mainframes, and other appropriate computers. The mobile computing device 550 is intended to represent various forms of mobile devices, such as personal digital assistants, cellular telephones, smart-phones, and other similar computing devices. The components shown here, their connections and relationships, and their functions, are meant to be examples only, and are not meant to be limiting.

The computing device 500 includes a processor 502, a memory 504, a storage device 506, a high-speed interface 508 connecting to the memory 504 and multiple high-speed expansion ports 510, and a low-speed interface 512 connecting to a low-speed expansion port 514 and the storage device 506. Each of the processor 502, the memory 504, the storage device 506, the high-speed interface 508, the high-speed expansion ports 510, and the low-speed interface 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as a display 516 coupled to the high-speed interface 508. In other implementations, multiple processors and/or multiple buses may be used, as appropriate, along with multiple memories and types of memory. Also, multiple computing devices may be connected, with each device providing portions of the necessary operations (e.g., as a server bank, a group of blade servers, or a multi-processor system).

The memory 504 stores information within the computing device 500. In some implementations, the memory 504 is a volatile memory unit or units. In some implementations, the memory 504 is a non-volatile memory unit or units. The memory 504 may also be another form of computer-readable medium, such as a magnetic or optical disk.

The storage device 506 is capable of providing mass storage for the computing device 500. In some implementations, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. Instructions can be stored in an information carrier. The instructions, when executed by one or more processing devices (for example, processor 502), perform one or more methods, such as those described above. The instructions can also be stored by one or more storage devices such as computer- or machine-readable mediums (for example, the memory 504, the storage device 506, or memory on the processor 502).

The high-speed interface 508 manages bandwidth-intensive operations for the computing device 500, while the low-speed interface 512 manages lower bandwidth-intensive operations. Such allocation of functions is an example only. In some implementations, the high-speed interface 508 is coupled to the memory 504, the display 516 (e.g., through a graphics processor or accelerator), and to the high-speed expansion ports 510, which may accept various expansion cards (not shown). In the implementation, the low-speed interface 512 is coupled to the storage device 506 and the low-speed expansion port 514. The low-speed expansion port 514, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 518, or multiple times in a group of such servers. In addition, it may be implemented in a personal computer such as a laptop computer 520. It may also be implemented as part of a rack server system 522. Alternatively, components from the computing device 500 may be combined with other components in a mobile device (not shown), such as a mobile computing device 550. Each of such devices may contain one or more of the computing device 500 and the mobile computing device 550, and an entire system may be made up of multiple computing devices communicating with each other.

The mobile computing device 550 includes a processor 552, a memory 564, an input/output device such as a display 554, a communication interface 566, and a transceiver 568, among other components. The mobile computing device 550 may also be provided with a storage device, such as a micro-drive or other device, to provide additional storage. Each of the processor 552, the memory 564, the display 554, the communication interface 566, and the transceiver 568, are interconnected using various buses, and several of the components may be mounted on a common motherboard or in other manners as appropriate.

The processor 552 can execute instructions within the mobile computing device 550, including instructions stored in the memory 564. The processor 552 may be implemented as a chip set of chips that include separate and multiple analog and digital processors. The processor 552 may provide, for example, for coordination of the other components of the mobile computing device 550, such as control of user interfaces, applications run by the mobile computing device 550, and wireless communication by the mobile computing device 550.

The processor 552 may communicate with a user through a control interface 558 and a display interface 556 coupled to the display 554. The display 554 may be, for example, a TFT (Thin-Film-Transistor Liquid Crystal Display) display or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may provide communication with the processor 552, so as to enable near area communication of the mobile computing device 550 with other devices. The external interface 562 may provide, for example, for wired communication in some implementations, or for wireless communication in other implementations, and multiple interfaces may also be used.

The memory 564 stores information within the mobile computing device 550. The memory 564 can be implemented as one or more of a computer-readable medium or media, a volatile memory unit or units, or a non-volatile memory unit or units. An expansion memory 574 may also be provided and connected to the mobile computing device 550 through an expansion interface 572, which may include, for example, a SIMM (Single In Line Memory Module) card interface. The expansion memory 574 may provide extra storage space for the mobile computing device 550, or may also store applications or other information for the mobile computing device 550. Specifically, the expansion memory 574 may include instructions to carry out or supplement the processes described above, and may include secure information also. Thus, for example, the expansion memory 574 may be provided as a security module for the mobile computing device 550, and may be programmed with instructions that permit secure use of the mobile computing device 550. In addition, secure applications may be provided via the SIMM cards, along with additional information, such as placing identifying information on the SIMM card in a non-hackable manner.

The memory may include, for example, flash memory and/or NVRAM memory (non-volatile random access memory), as discussed below. In some implementations, instructions are stored in an information carrier, such that the instructions, when executed by one or more processing devices (for example, processor 552), perform one or more methods, such as those described above. The instructions can also be stored by one or more storage devices, such as one or more computer- or machine-readable mediums (for example, the memory 564, the expansion memory 574, or memory on the processor 552). In some implementations, the instructions can be received in a propagated signal, for example, over the transceiver 568 or the external interface 562.

The mobile computing device 550 may communicate wirelessly through the communication interface 566, which may include digital signal processing circuitry where necessary. The communication interface 566 may provide for communications under various modes or protocols, such as GSM voice calls (Global System for Mobile communications), SMS (Short Message Service), EMS (Enhanced Messaging Service), or MMS messaging (Multimedia Messaging Service), CDMA (code division multiple access), TDMA (time division multiple access), PDC (Personal Digital Cellular), WCDMA (Wideband Code Division Multiple Access), CDMA2000, or GPRS (General Packet Radio Service), among others. Such communication may occur, for example, through the transceiver 568 using a radio-frequency. In addition, short-range communication may occur, such as using a Bluetooth, WiFi, or other such transceiver (not shown). In addition, a GPS (Global Positioning System) receiver module 570 may provide additional navigation- and location-related wireless data to the mobile computing device 550, which may be used as appropriate by applications running on the mobile computing device 550.

The mobile computing device 550 may also communicate audibly using an audio codec 560, which may receive spoken information from a user and convert it to usable digital information. The audio codec 560 may likewise generate audible sound for a user, such as through a speaker, e.g., in a handset of the mobile computing device 550. Such sound may include sound from voice telephone calls, may include recorded sound (e.g., voice messages, music files, etc.) and may also include sound generated by applications operating on the mobile computing device 550.

The mobile computing device 550 may be implemented in a number of different forms, as shown in the figure. For example, it may be implemented as a cellular telephone 580. It may also be implemented as part of a smart-phone 582, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term machine-readable signal refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

Although a few implementations have been described in detail above, other modifications are possible. For example, while a client application is described as accessing the delegate(s), in other implementations the delegate(s) may be employed by other applications implemented by one or more processors, such as an application executing on one or more servers. In addition, the logic flows depicted in the figures do not require the particular order shown, or sequential order, to achieve desirable results. In addition, other actions may be provided, or actions may be eliminated, from the described flows, and other components may be added to, or removed from, the described systems. Accordingly, other implementations are within the scope of the following claims.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A method performed by one or more computers of a text-to-speech system, the method comprising:

obtaining, by the one or more computers, data indicating a text for text-to-speech synthesis;

providing, by the one or more computers, data indicating a linguistic unit of the text as input to an encoder, the encoder being configured to output speech unit representations indicative of acoustic characteristics based on linguistic information, wherein the encoder is configured to provide speech unit representations learned through machine learning training, wherein the encoder comprises a neural network that was trained as part of an autoencoder network that includes the encoder, a second encoder, and a decoder, wherein:

the encoder is arranged to produce speech unit representations in response to receiving data indicating linguistic units;

the second encoder is arranged to produce speech unit representations in response to receiving data indicating acoustic features of speech units; and the decoder is arranged to generate output indicating acoustic features of speech units in response to receiving speech unit representations for the speech units from either of the encoder and the second encoder;

receiving, by the one or more computers, a speech unit representation that the encoder outputs in response to receiving the data indicating the linguistic unit as input to the encoder;

selecting, by the one or more computers, a speech unit to represent the linguistic unit, the speech unit being selected from among a collection of speech units based on the speech unit representation output by the encoder; and providing, by the one or more computers and as output of the text-to-speech system, audio data for a synthesized utterance of the text that includes the selected speech unit.

2. The method of claim 1, wherein the encoder is configured to provide speech unit representations of a same size to represent speech units having different durations.

3. The method of claim 1, wherein the encoder is trained to infer speech unit representations from linguistic unit identifiers, wherein the speech unit representations output by the encoder are vectors that have a same fixed length.

4. The method of claim 1, wherein the encoder comprises a trained neural network having one or more long-short-term memory layers.

5. The method of claim 1, wherein the encoder, the second encoder, and the decoder are trained jointly; and wherein the encoder, the second encoder, and the decoder each include one or more long short-term memory layers.

6. The method of claim 1, wherein the encoder, the second encoder, and the decoder are trained jointly using a cost function configured to minimize:

differences between acoustic features input to the second encoder and acoustic features generated by the decoder; and differences between the speech unit representations of the encoder and the speech unit representations of the second encoder.

7. The method of claim 1, further comprising selecting a set of candidate speech units for the linguistic unit based on a vector distances between (i) a first vector that includes the speech unit representation output by the encoder and (ii) second vectors corresponding to speech units in the collection of speech units; and generating a lattice that includes nodes corresponding to the candidate speech units in the selected set of candidate speech units.

8. The method of claim 7, wherein selecting the set of candidate speech units comprises:

identifying a predetermined quantity of second vectors that are nearest neighbors for the first vector; and selecting, as the set of candidate speech units, a set of speech units corresponding to the identified predetermined quantity of second vectors that are nearest neighbors for the first vector.

9. The method of claim 1, wherein the speech unit representation for the linguistic unit is a first speech unit representation for a first linguistic unit, wherein selecting the speech unit comprises:

obtaining a second speech unit representation for a second linguistic unit that occurs immediately before or after the first linguistic unit in a phonetic representation of the text;

generating a diphone unit representation by concatenating the first speech unit representation with the second speech unit representation; and selecting, to represent the first linguistic unit, a diphone speech unit identified based on the diphone speech unit representation.

10. A system comprising:

one or more computers; and one or more data storage devices storing instructions that, when executed by the one or more computers, cause the one or more computers to perform operations comprising:

obtaining, by the one or more computers, data indicating a text for text-to-speech synthesis;

providing, by the one or more computers, data indicating a linguistic unit of the text as input to an encoder, the encoder being configured to output speech unit representations indicative of acoustic characteristics based on linguistic information, wherein the encoder is configured to provide speech unit representations learned through machine learning training, wherein the encoder comprises a neural network that was trained as part of an autoencoder network that includes the encoder, a second encoder, and a decoder, wherein:

the encoder is arranged to produce speech unit representations in response to receiving data indicating linguistic units;

the second encoder is arranged to produce speech unit representations in response to receiving data indicating acoustic features of speech units; and the decoder is arranged to generate output indicating acoustic features of speech units in response to receiving speech unit representations for the speech units from either of the encoder and the second encoder;

receiving, by the one or more computers, a speech unit representation that the encoder outputs in response to receiving the data indicating the linguistic unit as input to the encoder;

selecting, by the one or more computers, a speech unit to represent the linguistic unit, the speech unit being selected from among a collection of speech units based on the speech unit representation output by the encoder; and providing, by the one or more computers and as output of the text-to-speech system, audio data for a synthesized utterance of the text that includes the selected speech unit.

11. The system of claim 10, wherein the encoder is configured to provide speech unit representations of a same size to represent speech units having different durations.

12. The system of claim 10, wherein the encoder is trained to infer speech unit representations from linguistic unit identifiers, wherein the speech unit representations output by the encoder are vectors that have a same fixed length.

13. The system of claim 10, wherein the encoder comprises a trained neural network having one or more long-short-term memory layers.

14. One or more non-transitory computer-readable media storing instructions that, when executed by one or more computers, cause the one or more computers to perform operations comprising:

obtaining, by the one or more computers, data indicating a text for text-to-speech synthesis;

providing, by the one or more computers, data indicating a linguistic unit of the text as input to an encoder, the encoder being configured to output speech unit representations indicative of acoustic characteristics based on linguistic information, wherein the encoder is configured to provide speech unit representations learned through machine learning training, wherein the encoder comprises a neural network that was trained as part of an autoencoder network that includes the encoder, a second encoder, and a decoder, wherein:

the encoder is arranged to produce speech unit representations in response to receiving data indicating linguistic units;

the second encoder is arranged to produce speech unit representations in response to receiving data indicating acoustic features of speech units; and the decoder is arranged to generate output indicating acoustic features of speech units in response to receiving speech unit representations for the speech units from either of the encoder and the second encoder;

receiving, by the one or more computers, a speech unit representation that the encoder outputs in response to receiving the data indicating the linguistic unit as input to the encoder;

selecting, by the one or more computers, a speech unit to represent the linguistic unit, the speech unit being selected from among a collection of speech units based on the speech unit representation output by the encoder; and providing, by the one or more computers and as output of the text-to-speech system, audio data for a synthesized utterance of the text that includes the selected speech unit.

15. The one or more non-transitory computer-readable media of claim 14, wherein the encoder is configured to provide speech unit representations of a same size to represent speech units having different durations.

16. The one or more non-transitory computer-readable media of claim 14, wherein the encoder is trained to infer speech unit representations from linguistic unit identifiers, wherein the speech unit representations output by the encoder are vectors that have a same fixed length.

17. The one or more non-transitory computer-readable media of claim 14, wherein the encoder comprises a trained neural network having one or more long-short-term memory layers.

* * * * *